US007600408B2

(12) United States Patent
Potter et al.

(10) Patent No.: US 7,600,408 B2
(45) Date of Patent: Oct. 13, 2009

(54) DOCKABLE TROLLEY FOR VEHICLE FRAME-STRAIGHTENING BENCH

(75) Inventors: Gregory Potter, Livonia, MI (US); Jeffery A. Hess, Elk Point, SD (US); Jeffrey L. Dobbins, Grand Island, NE (US); Richard Keefer, York, NE (US); Richard H. Nagorski, Grand Island, NE (US); Gregory Richards, Grand Island, NE (US); Randy Gard, Grand Island, NE (US)

(73) Assignee: Chief Automotive Technologies, Inc, Grand Island, NE (US)

( * ) Notice: Subject to any disclaimer, the term of this patent is extended or adjusted under 35 U.S.C. 154(b) by 0 days.

(21) Appl. No.: 11/852,693

(22) Filed: Sep. 10, 2007

(65) Prior Publication Data

US 2008/0066519 A1 Mar. 20, 2008

Related U.S. Application Data

(60) Provisional application No. 60/829,709, filed on Oct. 17, 2006, provisional application No. 60/826,305, filed on Sep. 20, 2006.

(51) Int. Cl.
*B21J 13/08* (2006.01)
*B21C 1/00* (2006.01)
*B21C 51/00* (2006.01)

(52) U.S. Cl. ..... 72/457; 72/705; 72/20.1

(58) Field of Classification Search ..... 72/413, 72/447, 457, 705, 20.1, 21.2, 21.6; 29/251
See application file for complete search history.

(56) References Cited

U.S. PATENT DOCUMENTS

| | | | | |
|---|---|---|---|---|
| 1,178,829 | A | 4/1916 | Stone | |
| 2,876,027 | A | 8/1959 | Sulmonetti | |
| 3,788,185 | A | 1/1974 | GUtshall | |
| 4,694,672 | A | 9/1987 | Baughman | |
| 4,791,802 | A | 12/1988 | Celette | |
| 5,058,286 | A | 10/1991 | Chisum | |
| 5,263,357 | A * | 11/1993 | Dumais | 72/457 |
| 5,784,921 | A | 7/1998 | Venalainen | |
| 6,269,676 | B1 | 8/2001 | Soyk | |
| 6,779,376 | B2 | 8/2004 | Linquist | |
| 7,269,990 | B1 * | 9/2007 | Espinosa | 72/447 |

* cited by examiner

*Primary Examiner*—Dana Ross
*Assistant Examiner*—Teresa M Bonk
(74) *Attorney, Agent, or Firm*—Spencer Fane Britt & Browne

(57) ABSTRACT

A trolley (30) for use with a frame-straightening bench (10) and allowing for moving a vehicle into the bench (10) for initial repair; moving the vehicle out of the bench (10) and into holding area to allow for curing or other time-consuming repair processes or operations, thereby making the bench (10) available for other uses; and moving the vehicle back into the bench (10) for additional repair or final confirmation of a previous repair. A repair jig (140) is coupleable with the trolley (30) for facilitating the alignment and otherwise proper positioning of a portion of the vehicle being repaired. The trolley (30) can also be used with a lift (2072) to separate the vehicle's body from its frame (2010).

21 Claims, 22 Drawing Sheets

DOCKABLE TROLLEY FOR VEHICLE FRAME-STRAIGHTENING BENCH

RELATED APPLICATIONS

The present U.S. non-provisional patent application is related to and claims priority benefit of an earlier-filed first U.S. provisional patent application of the same title, Ser. No. 60/826305, filed Sep. 20, 2006, and an earlier-filed second U.S. provisional patent application of the same title, Ser. No. 60/829,709, filed Oct. 17, 2006. The two earlier-filed patent applications are hereby incorporated by reference as though fully set forth herein.

FIELD OF THE INVENTION

The present invention relates to systems and apparatuses for straightening, replacing, or otherwise repairing the frames or other parts of vehicles. More specifically, the present invention concerns a dockable trolley for use with a vehicle frame-straightening bench, wherein the vehicle is anchored to the trolley and the trolley can be rolled into and out of the bench, and which includes a multi-positionable repair jig for positioning and securing a part of the vehicle being repaired. Additionally, the trolley can be used, in combination with a two-post lift, to facilitate replacement rather than repair of the frame.

BACKGROUND OF THE INVENTION

It is often necessary to repair the frame or other parts of a vehicle after the vehicle has been in a collision or accident that has bent or otherwise damaged the frame or other parts. In the U.S., such repair is commonly accomplished by securing the vehicle on a frame-straightening bench and exerting appropriate forces at appropriate locations and in appropriate directions to bend the frame back into its normal position. However, bending the frame in this manner is not always possible or recommended, such as when the frame is constructed of aluminum rather than steel. In Europe, repairs are commonly accomplished by removing and replacing the damaged part or portion of the frame rather than rebending it. This also requires the vehicle to be secured to a bench, and then the replacement portion is positioned and secured during the repair using appropriate fixtures. As an alternative to welding the replacement part, it is also common to use an adhesive to attach the replacement part. Some such adhesives require forty-eight hours or more to cure; during this time the vehicle remains secured to the bench and, therefore, the bench is unavailable for use for several days.

Alternatively, the damaged frame can be replaced rather than repaired. Unfortunately, the process of replacing a vehicle's frame can be laborious and time-consuming, particularly with regard to separating the body from the damaged frame and mounting the body onto the undamaged frame.

SUMMARY OF THE INVENTION

The present invention overcomes the above-identified and other problems and disadvantages by providing a trolley allowing for quickly and easily moving a vehicle into a frame-straightening bench for initial repair, moving the vehicle out of the bench and into a holding area to allow for curing or other time-consuming repair processes or operations, and moving the vehicle back into the bench for additional repair or final confirmation of a previous repair. Thus, it will be appreciated that the trolley of the present invention advantageously allows for minimizing use of the bench during a time-consuming repair, thereby allowing for a plurality of repairs to be simultaneously undertaken.

In one embodiment, the trolley comprises a body adapted to fit through an opening and into an internal area of a frame-straightening bench, a plurality of rollable supports coupled with the body for facilitating rolling movement of the trolley into and out of the internal area of the bench, and an anchor member coupled with the body and adapted to allow for anchoring a vehicle to the trolley.

In one embodiment, the bench includes a series of spaced-apart slots located along an edge adjacent to the internal area, and the trolley includes a corresponding series of spaced-apart teeth which fit within the slots, thereby securely engaging the bench with the trolley. In one embodiment, the slots and teeth are not evenly spaced-apart, such that the teeth will only fit within the slots when the trolley is properly positioned relative to the bench.

In one embodiment, a sensor is mounted on either the bench or the trolley and operable to determine whether the trolley is fully received into the internal area.

In one embodiment, each of the rollable supports is removably coupleable with the body of the trolley in at least two different orientations relative to the body of the trolley.

In one embodiment either the trolley or the bench includes a plurality of guide rollers for facilitating inserting the trolley through the opening and into the internal area. In one embodiment, either the trolley or the bench is chamfered to facilitate insertion of the trolley through the opening and into the internal area.

In one embodiment, the anchor member includes an anchor base having a first elongated slot oriented in a first direction and a second elongated slot oriented in a second direction, wherein the second direction is substantially perpendicular to the first direction, and operable to allow for adjusting in two dimensions the position of the anchor hardware.

In one embodiment, a lift is incorporated into the bench and adapted to raise and lower both the bench and the trolley docked therewith. In one embodiment, the lift includes a vertically elongated slot at one end to allow for tilting the bench and the trolley docked therewith. In one embodiment, the lift includes a locking feature for preventing inadvertent lowering of the lift. In one embodiment, the locking feature includes a series of teeth, each of which substantially automatically engages at a different height as the lift is raised, and a disengagement mechanism for disengaging the series of teeth and allow the lift to be lowered.

In one embodiment, a repair jig is removably coupleable with the trolley and operable to securely position a portion of the vehicle being repaired. In one embodiment, the repair jig includes a rail including an elongated channel, a base adapted both to slidably couple with the elongated channel of the rail and to allow for adjusting in at least two dimensions the positioning of the repair jig, an extension in the form of an elongated shaft including a first end attached to the base, and a fixture jig including a fixture clamp, wherein the fixture jig is adapted to allow for adjusting in three dimensions the positioning of the fixture clamp, and the fixture clamp is operable to clamp on to the portion of the vehicle being repaired. In one embodiment, the base includes lower, middle, and upper elements, with the middle element being movable in a first horizontal direction relative to the lower element, and the upper element being movable in a second horizontal direction, wherein the first horizontal direction is perpendicular to the second horizontal direction, relative to the middle element. In one embodiment, the fixture jig includes a screw receiver including a concave portion, a threaded rod extending outwardly from a center area of the concave portion, and a screw head including a convex portion, wherein the threaded rod is passed through an existing hole in a vehicle, and the screw head is screwed onto the threaded rod so as to trap the material surrounding the hole in the vehicle between the screw receiver and the screw head, and wherein the convex portion effectively expands and centers itself, as the screw head is screwed onto the threaded rod, in the hole in the vehicle, thereby accommodating substantially any size hole, and wherein the concave portion accepts that part of the convex portion that extends through the hole in the vehicle.

In one embodiment, a pulling apparatus is coupleable with either the trolley or the bench for exerting a pulling force on a portion of the vehicle being repaired.

In one embodiment, a removable crossmember is selectively positionable across the opening in the bench when it is desired to use the bench without first docking the trolley therewith.

In one embodiment, the process of making a repair using the trolley and bench comprises the steps of lowering the bench; positioning the vehicle on the bench; moving the trolley into an internal area of the bench which is substantially beneath the vehicle; raising the bench such that the bench engages the trolley, and then raising the engaged bench and trolley; positioning an anchor member relative to the vehicle and securing the anchor member to at least the trolley; anchoring the vehicle to the anchor member; positioning a fixture jig relative to the vehicle and securing the fixture jig to the trolley; using the fixture jig to position a part of the vehicle associated with the repair; making the repair, wherein the repair requires a curing time; lowering the engaged bench and trolley until the trolley disengages from the bench; and moving the trolley and the vehicle anchored thereto away from the bench so that the bench is available for other uses during the curing time of the repair.

In one embodiment, the trolley is also useable with a lift to separate the vehicle body from the frame, such as when replacing the frame. This embodiment makes use of an apparatus comprising a clamp fixture for attachment to the body, the clamp fixture including a securement member, a faceplate secured to the securement member, and a clamping element for cooperating with the faceplate to clamp a portion of the body therebetween, and a hinged adaptor for attachment to an arm of a two-post lift, the hinged adaptor including a first portion coupleable with the arm, and a second portion hingeably movable and securable relative to the first portion to define an internal area, wherein the securement member of the clamp fixture is receivable within the internal area defined by the secured first and second portions of the hinged adaptor.

In one embodiment, the process of separating the vehicle's body from its frame comprises the steps of raising the vehicle using a lift; positioning a trolley having frame stands under the vehicle; lowering the vehicle onto the trolley such that the frame rests on the frame stands; disconnecting the frame from the vehicle body; attaching a fixture to the vehicle body by clamping on to portion of the vehicle body; attaching an adapter on to an arm of a lift; securing the adapter to the fixture; and raising the arm of the lift and thereby raising the vehicle body off of the frame. When it is desired to replace the frame, the method further includes the steps of moving the trolley and the frame resting thereon away from the lift; moving a second trolley having a replacement frame resting thereon beneath the vehicle body; lowering the arm of the lift and thereby lowering the vehicle body on to the replacement frame; and connecting the replacement frame to the vehicle body.

These and other features of the present invention are described in greater detail in the section below titled DETAILED DESCRIPTION.

BRIEF DESCRIPTION OF THE DRAWING FIGURES

DETAILED DESCRIPTION

With reference to the figures, a dockable trolley 30 is herein described, shown and otherwise disclosed in accordance with various embodiments, including a preferred embodiment, of the present invention. Broadly, the trolley 30 allows for quickly and easily moving a vehicle into a frame-straightening bench 10 for initial repair, moving the vehicle out of the bench 10 and into a holding area to allow for curing or other time-consuming repair processes or operations, and moving the vehicle back into the bench 10 for additional repair or final confirmation of a previous repair. Thus, it will be appreciated that the trolley 30 of the present invention advantageously allows for minimizing use of the bench 10 during a time-consuming repair, thereby allowing for a plurality of repairs to be simultaneously undertaken.

Figure 1:
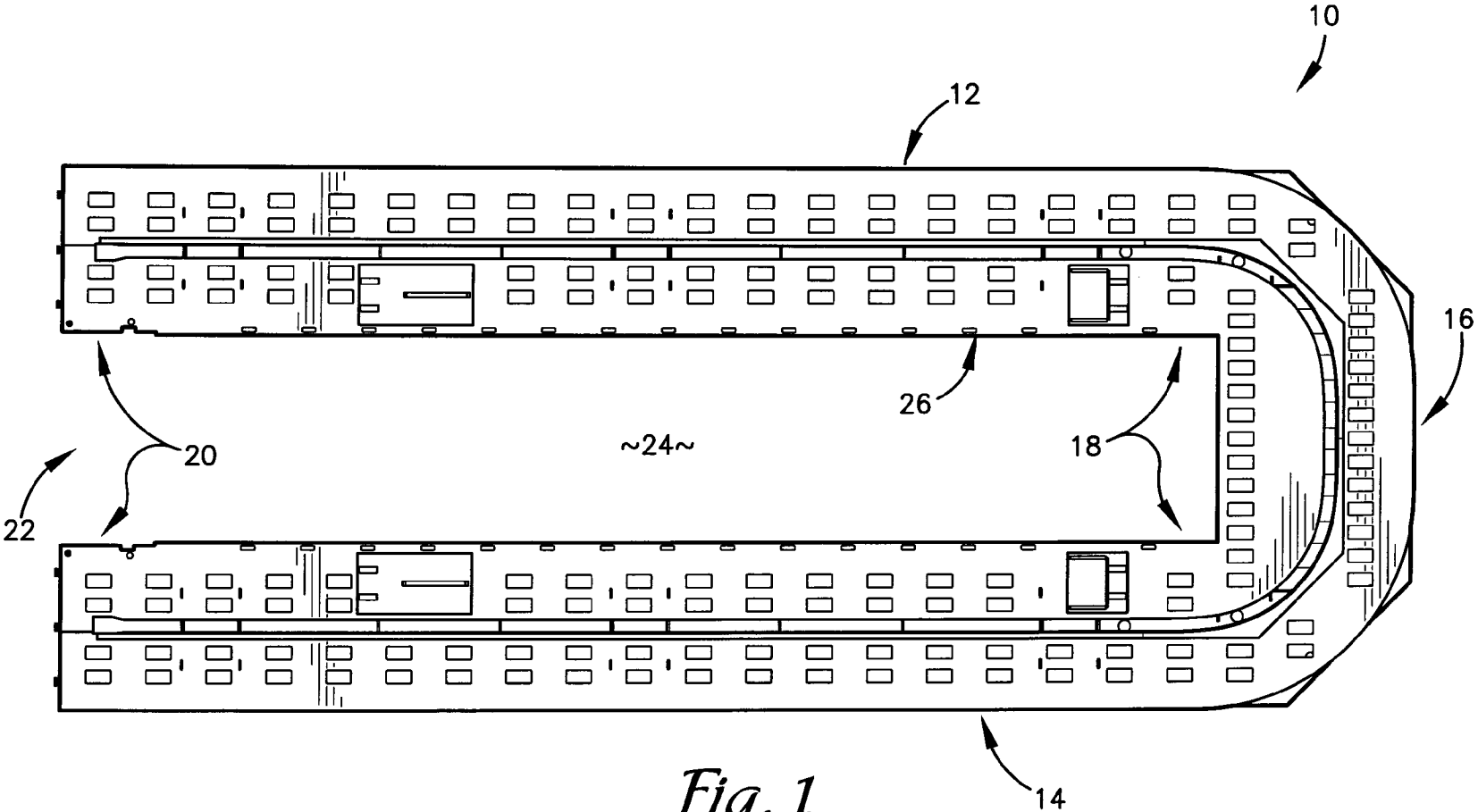
FIG. 1 is a plan view of an embodiment of a frame-straightening bench which may be used with the present invention.
Figure 2:
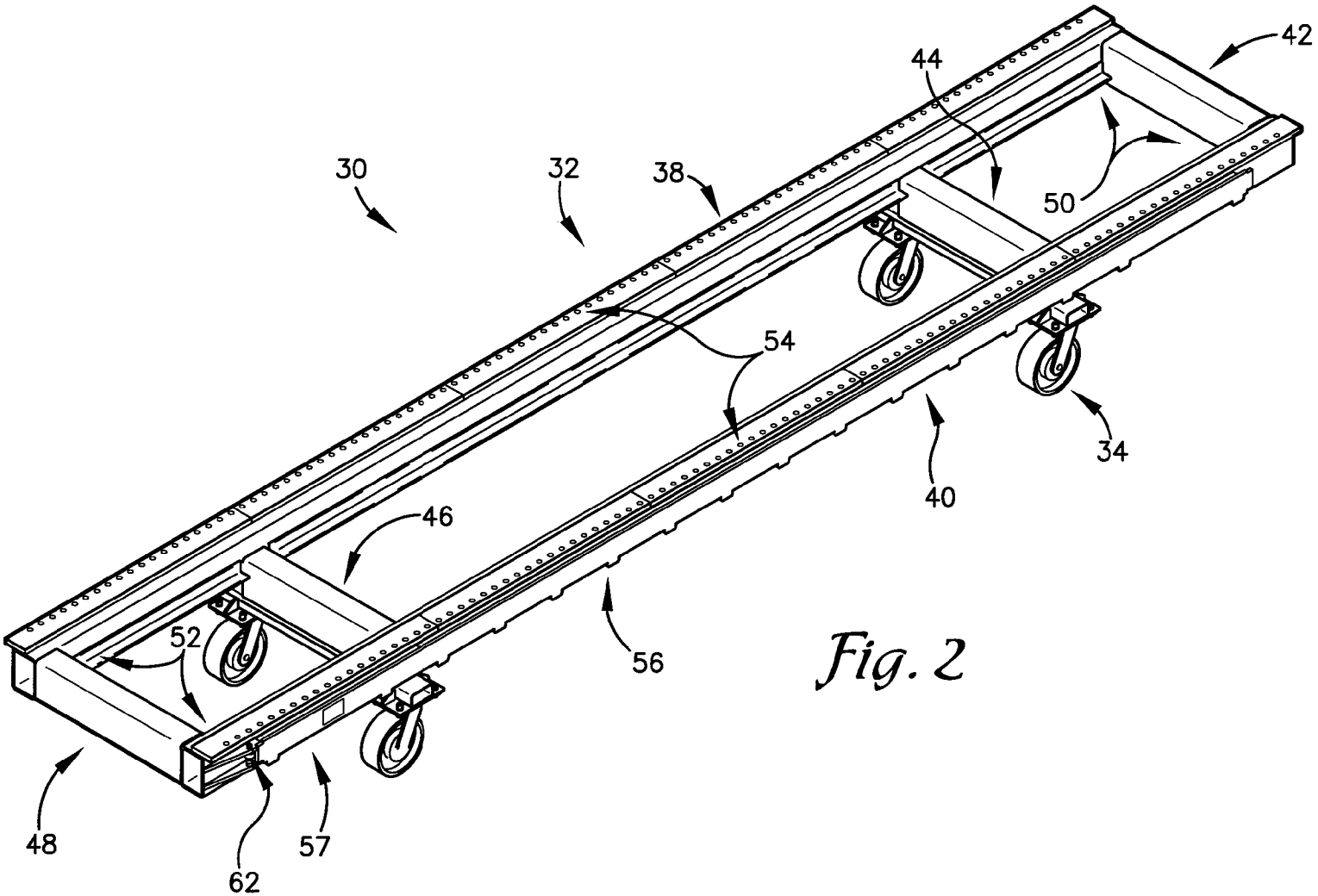
FIG. 2 is an isometric view of an embodiment of a dockable trolley of the present invention which may be docked with the bench of FIG. 1.
Figure 3:
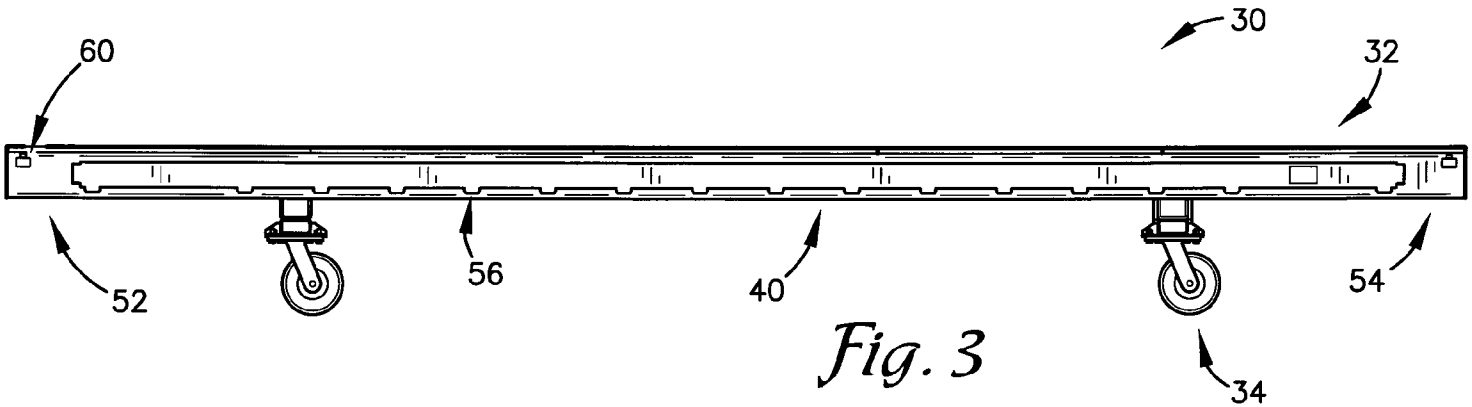
FIG. 3 is a side elevation view of the trolleys of FIG. 2.

Referring to FIG. 1, an embodiment of the frame-straightening bench 10 is shown comprising first 12, second 14, and third bench portions 16. The first and second bench portions 12,14 are each substantially elongated, with first and second ends 18,20, and positioned spaced apart and parallel to the other. The first and second bench portions 12,14 each include a series of slots 26 spaced-apart along an inner edge, i.e., the edge closest to the other bench portion. The third bench portion 16 extends between and connects the first ends 18 of the first and second bench portions 12,14. The second ends 20 of the first and second bench portions 12,14 are unconnected, creating an opening 22 into an internal area 24 defined by the first, second, and third bench portions 12,14,16. In one embodiment, the internal area 24 is substantially rectangular in shape.

In one embodiment, the bench 10 may be substantially similar in at least some respects to the bench disclosed in U.S. Pat. No. 6,925,848, titled "Multiple Movable Carriages with Multi-Radius Tracks and Tilted Rollers," which is hereby incorporated by reference into the present specification.

Figure 27:
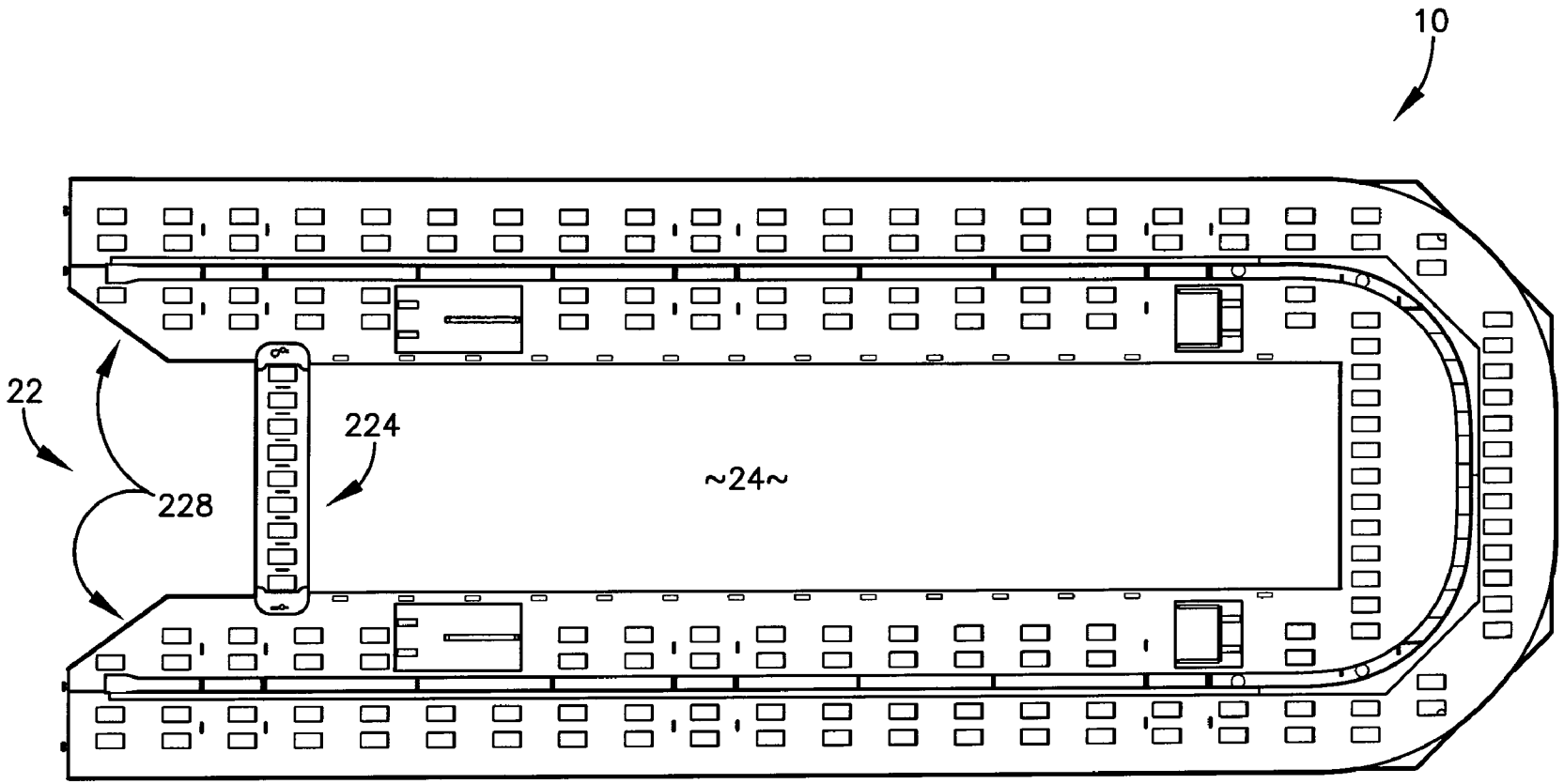
FIG. 27 is a plan view of the bench of FIG. 1 including a crossmember.

Referring also to FIG. 27, in one embodiment, the inner corners 228 of the second ends 20 of the first and second bench portions 12,14 of the bench 10 may be chamfered to facilitate insertion of the trolley 30 through the opening 22 and into the internal area 24. Additionally or alternatively, the ends of the trolley 30 may be chamfered to accomplish the same purpose.

Figure 6:
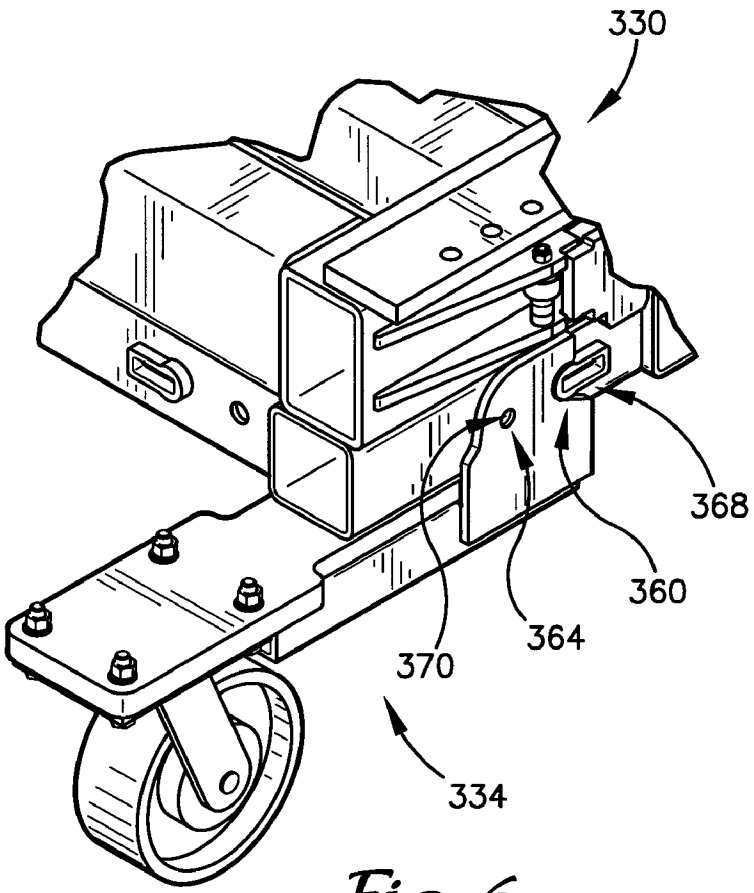
FIG. 6 is an isometric view of the removable support of FIG. 5 shown coupled with the trolley.
Figure 7:
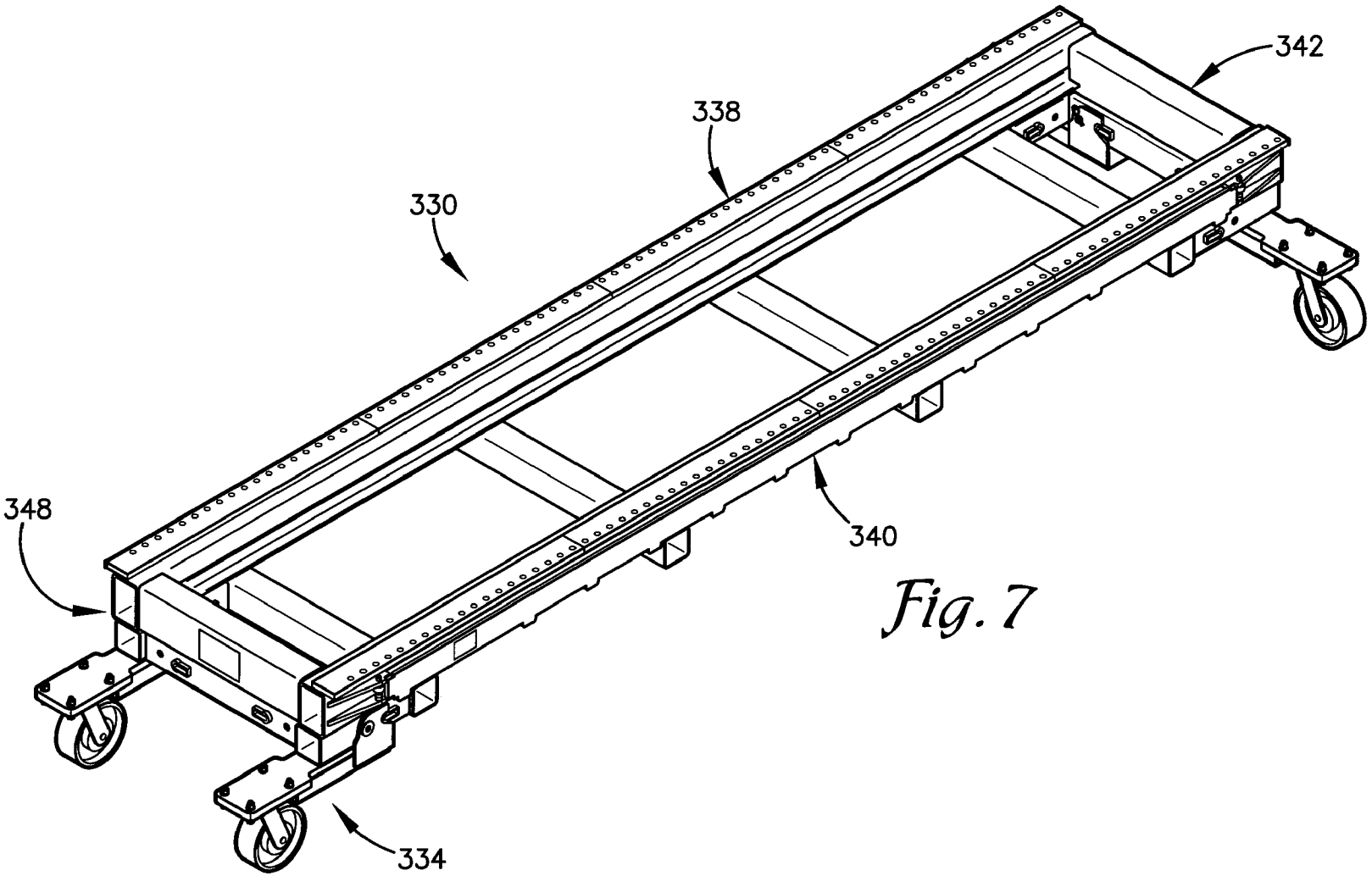
FIG. 7 is an isometric view of a plurality of the removable supports of FIG. 5 shown coupled with the trolley.
Figure 8:
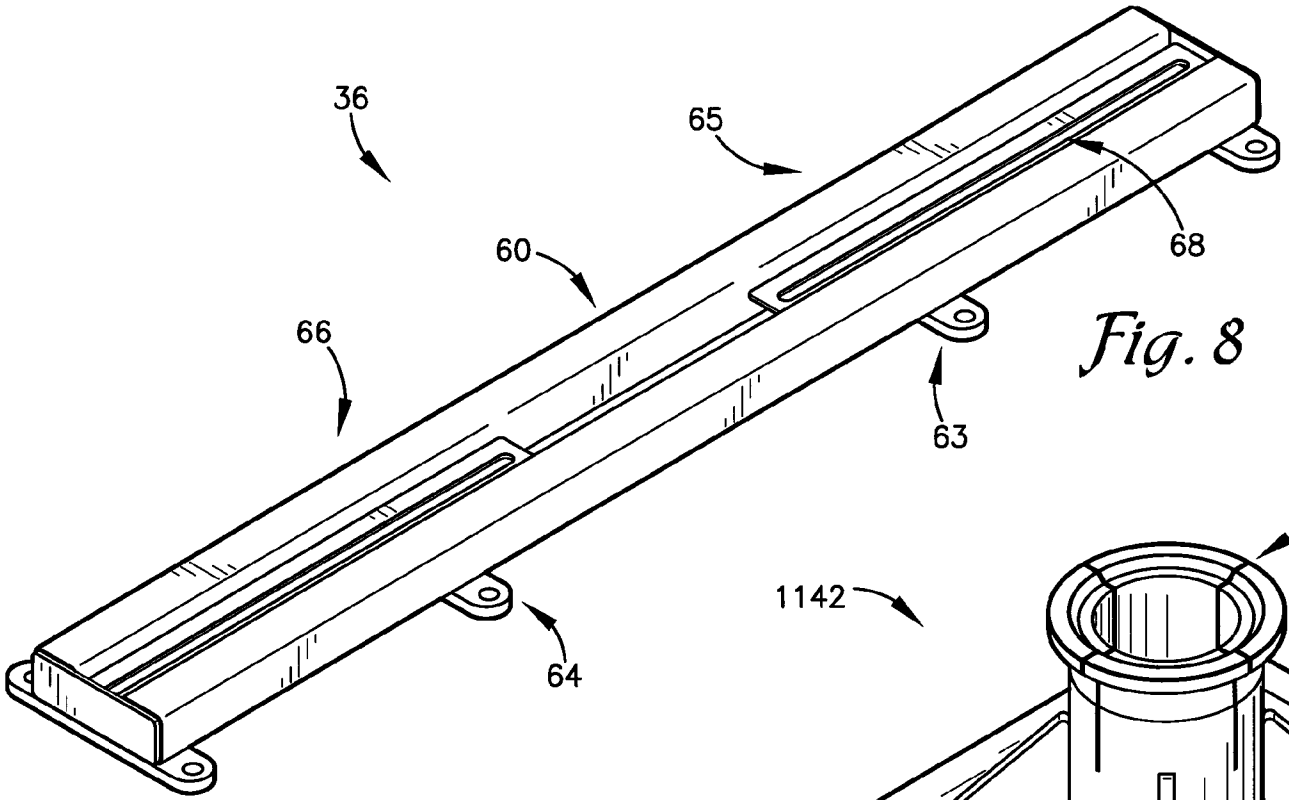
FIG. 8 is an isometric view of an embodiment of an anchor member for use with the trolley of FIG. 2.

Referring also to FIGS. 2-9, an embodiment of the trolley 30 is shown comprising a body 32, a plurality of supports 34, and a selectively positionable anchor member 36 (see FIG. 8). The body includes first, second, third, fourth, fifth, and sixth trolley portions 38-48. The first and second trolley portions 38,40 are each substantially elongated, with first and second ends 50,52, and positioned spaced apart and parallel to the other. The first and second trolley portions 38,40 each include a series of spaced-apart holes 54 along an upper surface of the trolley portion, and a series of spaced-apart teeth 56 along a lower surface of the trolley portion. The teeth 56 may be radiused or chamfered to facilitate alignment with and insertion into the slots 26 in the bench 10. Alternatively or additionally, the slots 26 may be tapered or otherwise shaped to facilitate alignment with the teeth 56. As discussed below, the teeth 56 are received within the slots 26 along the inner edges of the bench 10 to ensure both positive engagement and alignment of the trolley 30 with the bench 10, and, as such, one or more teeth 56 (or one or more slots 26) may be eliminated leaving a space 57, or one or more teeth 56 (or one or more slots 26) may be unevenly spaced apart, so that the bench 10 and trolley 30 will positively engage and align with each other only in particular relative positions. The first and second trolley portions 38,40 also include a plurality of guide rollers 60, with at least one guide roller 60 being located at each outer corner of the first and second ends 50,52 of the first and second trolley portions 38,40. In one embodiment, some or all of the guide rollers 60 are vertically adjustable to accommodate uneven floor surfaces. In another embodiment, the guide rollers 60 are provided on the inside corners of the second ends 20 of the first and second portions 12,14 of the bench 10 to achieve substantially the same effect.

Figure 4:
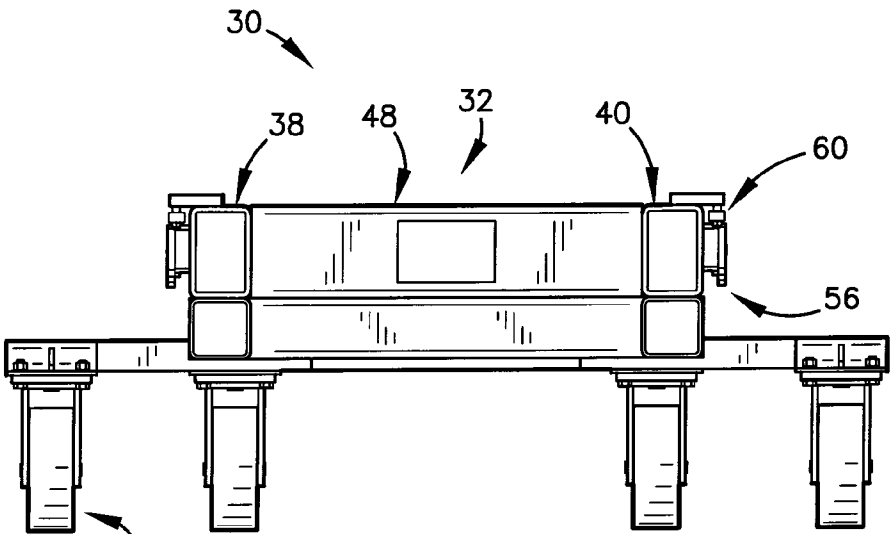
FIG. 4 is an end elevation view of the trolley of FIG. 2.

The third trolley portion 42 extends between and connects the first ends 50 of the first and second trolley portions 38,40. The fourth and fifth trolley portions 44,46 extend between and connect intermediate areas of the first and second trolley portions 38,40. The first and second trolley portions 38,40 may include both upper and lower elements for additional strength, as seen in FIG. 4, with the rollable supports 34 being attached to the lower elements. In one embodiment, the fourth and fifth trolley portions 44,46 attach to the first and second trolley portions 38,40 at locations approximately one-quarter of the distance from the respective first or second ends 50,52. The sixth trolley portion 48 extends between and connects the second ends 52 of the first and second trolley portions 38,40. The third and sixth trolley portions 42,48, which are located at opposite ends of the trolley 30, may include stop projections or bumpers to define the extent to which the trolley 30 is received with in the bench 10. More specifically, it may be desirable to include the stop projections or bumpers so that the third or sixth trolley portion 42,48 does not physically touch the third bench portion 16 when the trolley 30 is received within the internal area 24 of the bench 10, and thereby allow sufficient room for, for example, expansion of the metal parts. In one embodiment, the body 32 is substantially rectangular in shape. Some or all of the body portions 38-48 may be constructed from four inch by four inch square tubing, or similarly suitable material, and may be fixed in their positions relative to one another, such as by welding, or may be movably or replaceably coupled with one another, such as by bolts or other releasable connectors. The use of four inch by four inch square tubing allows for, for example, receiving a pulling apparatus similar to that which is disclosed in U.S. Pat. No. 6,484,554, titled "Portable Lift and Straightening Platform."

The plurality of supports 34 allow for quickly and easily moving the trolley 30. In one embodiment, the supports are rollable supports. In the embodiment shown, for example, there are four rollable supports 34, with one being located at each of the intersections of the first and second trolley portions 38,40 with the fourth and fifth trolley portions 44,46. The rollable supports 34 may take the form of single-wheeled casters, double-wheeled casters, or ball casters, pivotably mounted to the body 32. In alternative embodiments, the supports are not rollable but rather are designed to allow for sliding the trolley or engaging a track.

Figure 5:
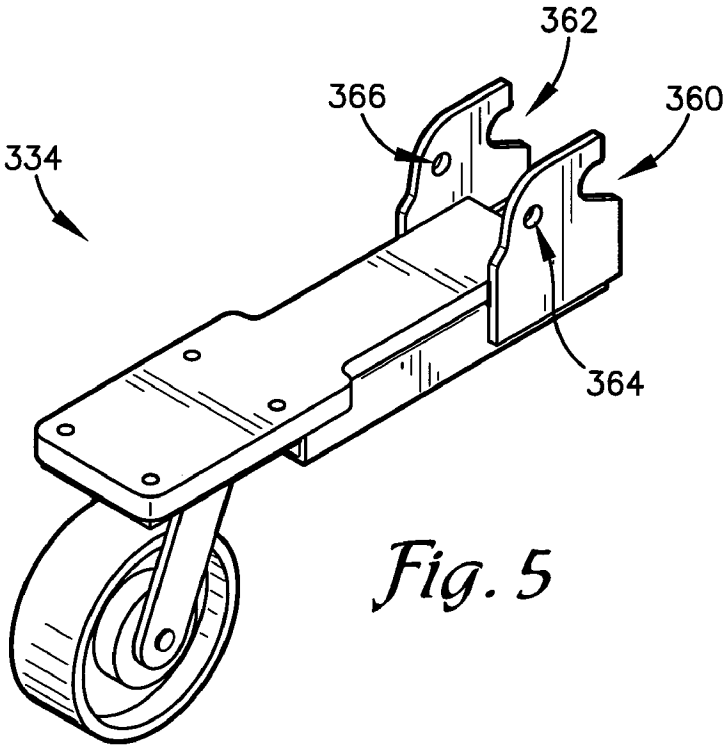
FIG. 5 is an isometric view of a removable support for use with the trolley of FIG. 2.

Referring particularly to FIGS. 5, 6, and 7, in one embodiment the plurality of supports 334 are removably coupleable with the trolley 330. This advantageously allows for positioning the trolley 330 lower relative to the vehicle, fully lowering the bench with the trolley 330 docked therewith, and, as discussed below, orienting the supports as necessary or desired depending, for example, on which end of the trolley 330 is to be inserted into the bench. As shown, for example, each support 334 includes first and second hooks 360,362 and first and second holes 364,366, and each of the first, second, third, and sixth portions 338,340,342,348 include at each end thereof, i.e., at the corners of the trolley 330, on both the interior and exterior sidewall surfaces, a projection 368 and a third hole 370. When coupling the support 334 with the corner of the trolley 330, the support 334 is positioned with the first and second hooks 360,362 initially engaged with the corresponding interior and exterior projections 368, and then the support 334 is rotated relative to the trolley 330 to its operating position, thereby fully engaging the hooks 360,362 on the projections 368 and aligning the first, second, and third holes 364,366,370. A pin can then be inserted through the aligned holes 364,366,370 to further secure the support 334 to the trolley 330 and prevent inadvertent disconnection therefrom. As mentioned, the projections 368 and third holes 370 are provided on each side of the trolley 330, adjacent a corner thereof, which allows for coupling the support 334 in either of two orientations (as best seen in FIG. 7). When uncoupling the support 334 from the trolley 330, the preceding process is reversed.

The positionable anchor member 36 (see FIG. 8) allows for anchoring the vehicle to the trolley 30, and includes an elongated portion 60 and a plurality of mounting brackets 63,64. The elongated portion 60 includes first and second ends 65,66, and is substantially longer than the width of the body 32, so that when the anchor member 36 is placed laterally across the body 32, the first and second ends 65,66 of the elongated portion 60 extend beyond the respective first and second trolley portions 38,40 and over the respective first and second bench portions 12,14. The first and second ends 65,66 each include an elongated slot 68 for slidably receiving anchor hardware. First and second mounting brackets 63,64 are fixedly attached to a lower surface of the elongated portion 60 and present openings for receiving fastenings for securing the anchor member 36 to the body 32 of the trolley 30. More specifically, the first mounting bracket 63 is associated with the first end 65 of the anchor member 36 and includes holes for receiving bolts or other fasteners which extend through the holes in the mounting bracket 63 and into the holes 54 in the first trolley portion 38. The second mounting bracket 64 is associated with the second end 66 of the anchor member 36 and includes holes for receiving bolts or other fasteners which extend through the holes in the mounting bracket 64 and into the holes 54 in the second trolley portion 40. As such, the first and second mounting brackets 63,64 are spaced apart a distance approximately equal to the distance between the series of holes 54 in the first trolley portion 38 and the series of holes 54 in the second trolley portion 40.

Figure 9:
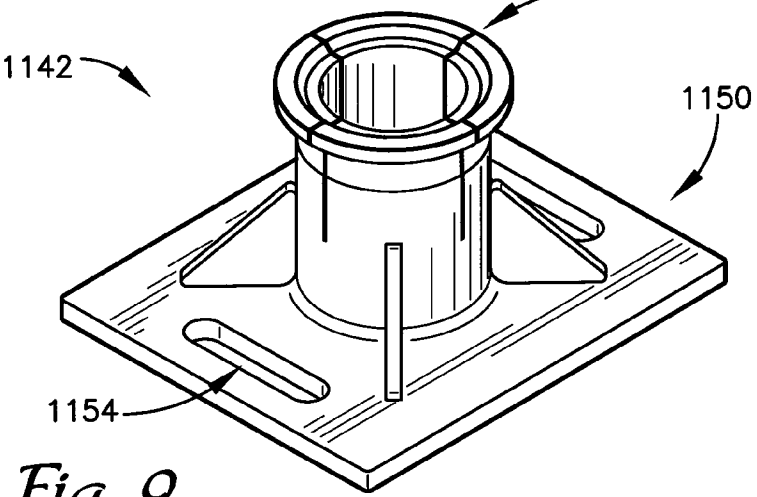
FIG. 9 is an isometric view of an anchor base for use with the anchor member of FIG. 8.
Figure 10:
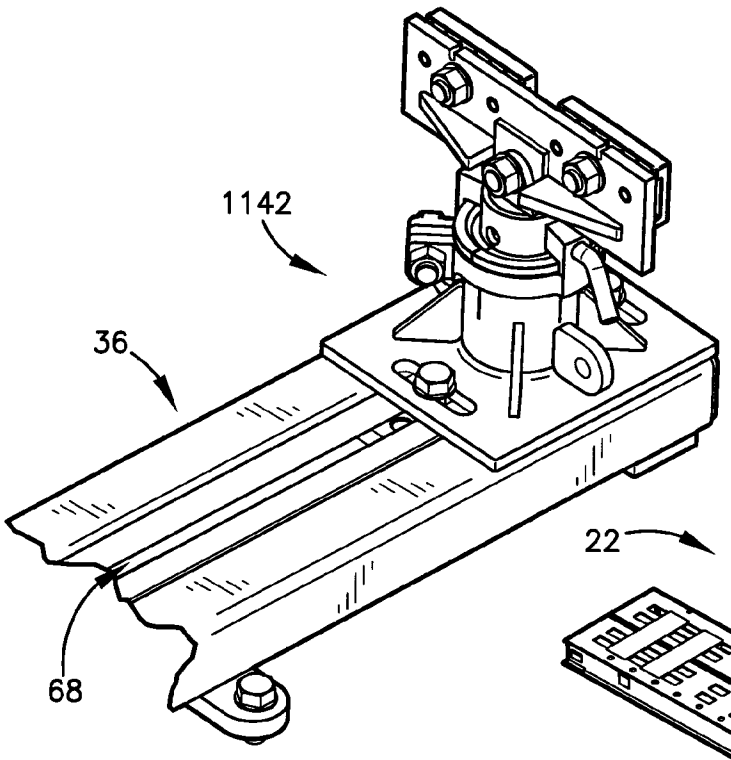
FIG. 10 is a perspective view of the anchor base of FIG. 9 on the anchor member of FIG. 8.

Referring particularly to FIGS. 9 and 10, in one embodiment, an anchor base 1142 is provided for receiving and securing the anchor hardware to the anchor member 36 while allowing for adjustments to the position of the anchor hardware in at least two dimensions. The anchor base 1142 includes a lower portion 1150 and a receiver 1152. The lower portion 1150 includes elongated slots 1154 for receiving bolts or other fasteners for coupling the anchor base 1142 to the slots 68 in the anchor member 36. Thus, the anchor base 1142 can be moved along the slots 68 in the anchor member 36 in a first direction which is perpendicular to the trolley 30, and the anchor base 1142 can be moved along the slots 1154 in a second direction which is parallel to the trolley 30. The receiver 1152 receives and secures the anchor hardware. In one embodiment, the length of the elongated slots 1154 is approximately equal to the spacing between the series of holes 54 in the surface of the first and second trolley portions 38,40 so that the elongated slots 1154 in the anchor base 1142 allow for making adjustments to the position of the anchor hardware between adjacent holes 54.

Figure 11:
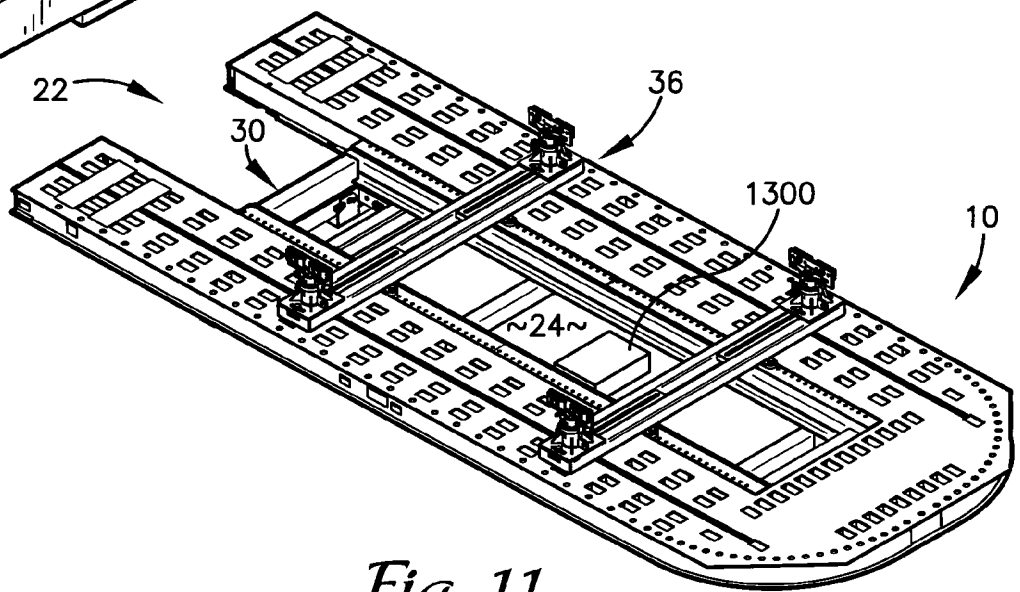
FIG. 11 is an isometric view of the trolley of FIG. 2 docked with the bench of FIG. 1.
Figure 12:
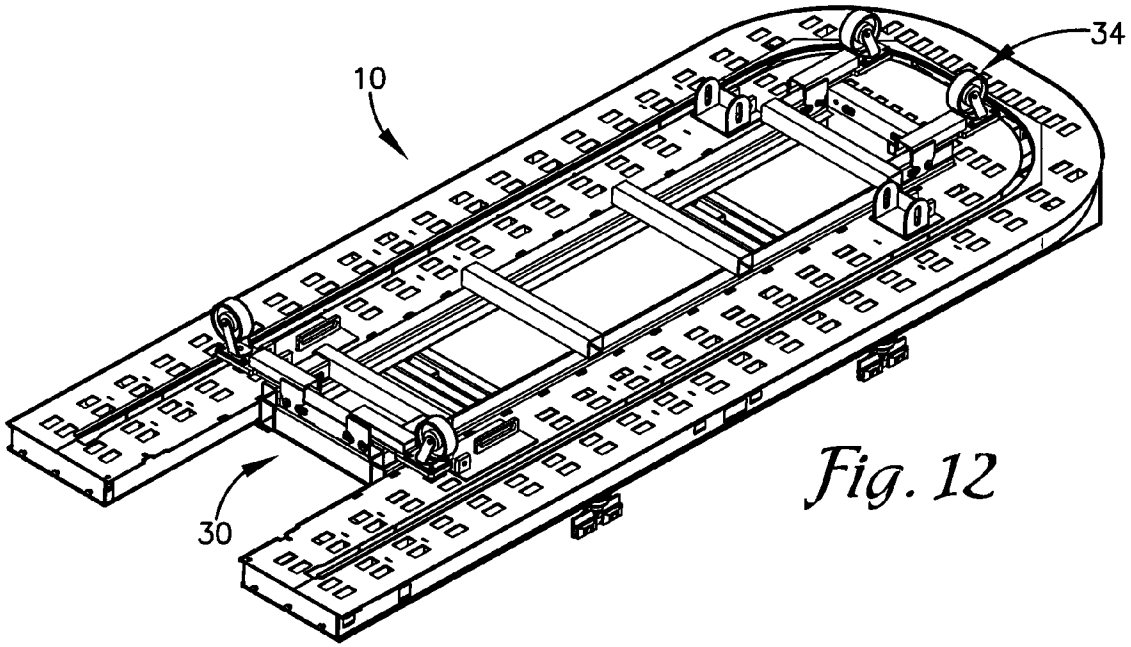
FIG. 12 is an isometric view of the trolley of FIG. 2 docked with the bench of FIG. 1.

Referring also to FIGS. 11 and 12, the trolley 30 is closely receivable, through the opening 22, into the internal area 24 defined by the bench 10. More specifically, by pushing the trolley 30 on its rollable supports 34, the first ends 50 can be approximately aligned with the opening 22. As the trolley 30 is then pushed into the opening 22, the guide rollers 62 on the corners of the first ends 50 assist in further aligning the trolley 30 with the opening 22 and with guiding the trolley 30 into the internal area 24. The first and second ends 65,66 of the anchor member 36 overlap respective first and second bench portions 12,14. Once the trolley 30 is fully received with the bench 10, the trolley 30 can be lowered, or the bench 10 raised, so that the teeth 56 of the trolley 30 are received within the slots 26 of the bench 10, thereby locking the trolley 30 and bench 10 together. Thereafter, the vehicle anchored to the trolley 30 can be repaired, or a previous repair can be checked, using the bench 10. When a repair is complete, or when a repair requires curing or other time-consuming activity, the aforementioned process is reversed and the trolley 30 is disengaged and removed from the bench 10 so that the bench 10 is free to receive other trolleys and/or for making repairs on other vehicles.

In one embodiment, a switch or other sensor is incorporated into the trolley 30 or bench 10 to confirm proper alignment and engagement of the trolley 30 with the bench 10. For example, a switch may be incorporated into the inner edge or surface of the third bench portion 16 or the third trolley portion 42 so that when the trolley 30 is fully and properly received within the internal area 24, such that the third trolley portion 42 abuts the third bench portion 16, the switch is activated and an indicator or a telltale is lit. In an alternative embodiment, the switch is used to determine if the innermost tooth 56 is received in the inner most slot 26.

Figure 13:
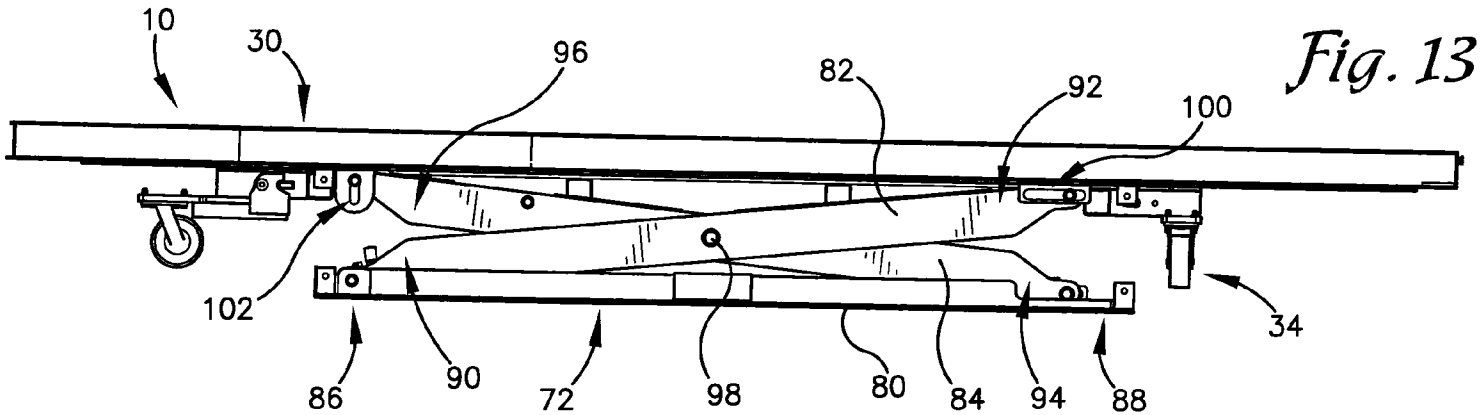
FIG. 13 is a side elevation view of an embodiment of a lift associated with the bench of FIG. 1, wherein the lift is shown in a parallel orientation.
Figure 14:
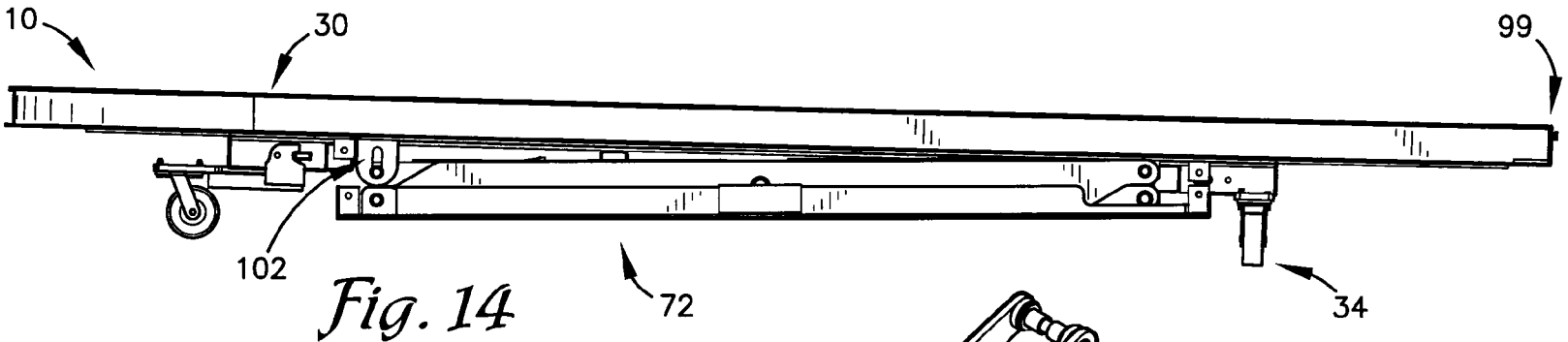
FIG. 14 is a side elevation view of an embodiment of the lift of FIG. 13, wherein the lift is shown in a slanted orientation.

Referring also to FIGS. 13 and 14, in one embodiment the bench 10 includes a lift 72 for lifting and lowering the bench 10 as needed, especially with regard to engaging with and disengaging from the trolley 30. In one embodiment, the lift 72 is a scissor-type lift including a base 80, a first arm 82, and a second arm 84. The base 80 is substantially elongated and includes first and second ends 86,88. The first and second arms 82,84 are substantially elongated and include first and second ends 90,92,94,96. The first end 90 of the first arm 82 is pivotably coupled with the first end 86 of the base 80; the first end 94 of the second arm 84 is pivotably coupled with the second end 88 of the base 80. Each arm 82,84 is pivotably coupled to the other at an intermediate point 98 located approximately halfway between the first and second ends 90,92,94,96. The second end 92 of the first arm 82 is pivotably and horizontally slidably coupled with a first fitting 100 on the bench 10; the second end 96 of the second arm 84 is pivotably and vertically slidably coupled with a second fitting 102 on the bench 10. More specifically, the second fitting 102 provides a vertically elongated slot in which the pivot point is allowed to move vertically to allow for tilting the bench 10 to lower the loading end 99 of the bench 10 and thereby facilitate loading and unloading the vehicle, as shown in FIG. 14.

Figure 15:
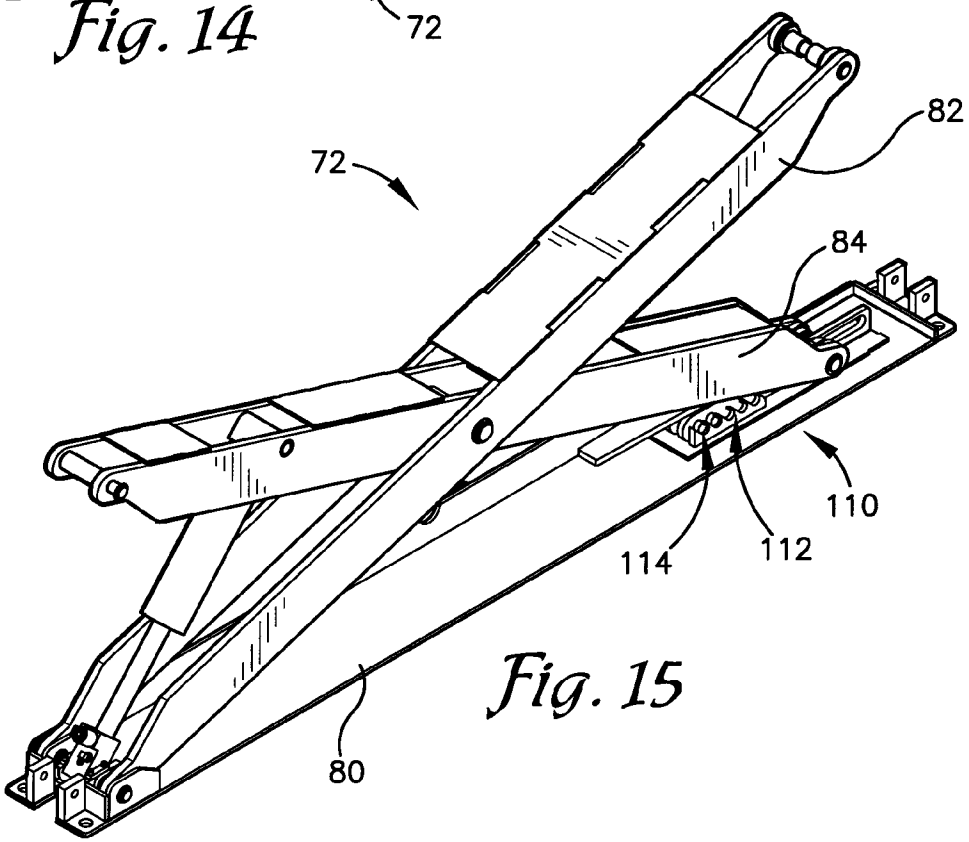
FIG. 15 is an isometric view of the lift of FIGS. 13 and 14 showing an embodiment of a locking feature incorporated into the lift.

Referring also to FIG. 15, in one embodiment, the lift 72 is provided with a locking feature 110 to prevent inadvertent lowering of the lift 72. The locking feature 110 includes a series of receivers 112 and one or more teeth 114 that cooperate in a ratchet-like action to freely allow lifting motion while limiting lowering motion. More specifically, the receivers 112 are slantingly oriented so that the teeth 114 substantially automatically slide over each receiver 112 as the lift 72 is raised. As the teeth 114 slide up and over each receiver 112, an audible sound can be heard which indicates that the locking feature 110 is operating properly and that a locking position has been reached. The teeth 114 engage the receivers 112 as the lift 72 is being lowered, thereby preventing the lift 72 from being inadvertently lowered. In order to lower the lift 72, the teeth 114 must be disengaged from the receivers 112 during the lowering process. In one embodiment, the locking feature 110 may be substantially similar in at least some respects to the locking feature disclosed in U.S. Pat. No. 6,601,430, titled "Jack with Elevatable Platform," which is hereby incorporated by reference into the present specification.

Figure 16:
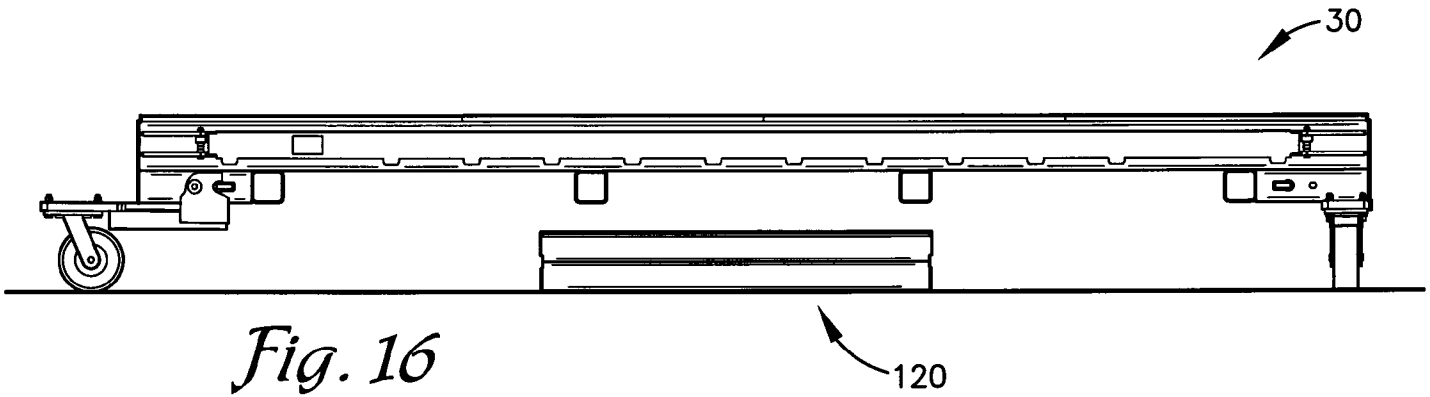
FIG. 16 is a side elevation view of an alternative embodiment of the lift, wherein the lift is shown in a lowered configuration.
Figure 17:
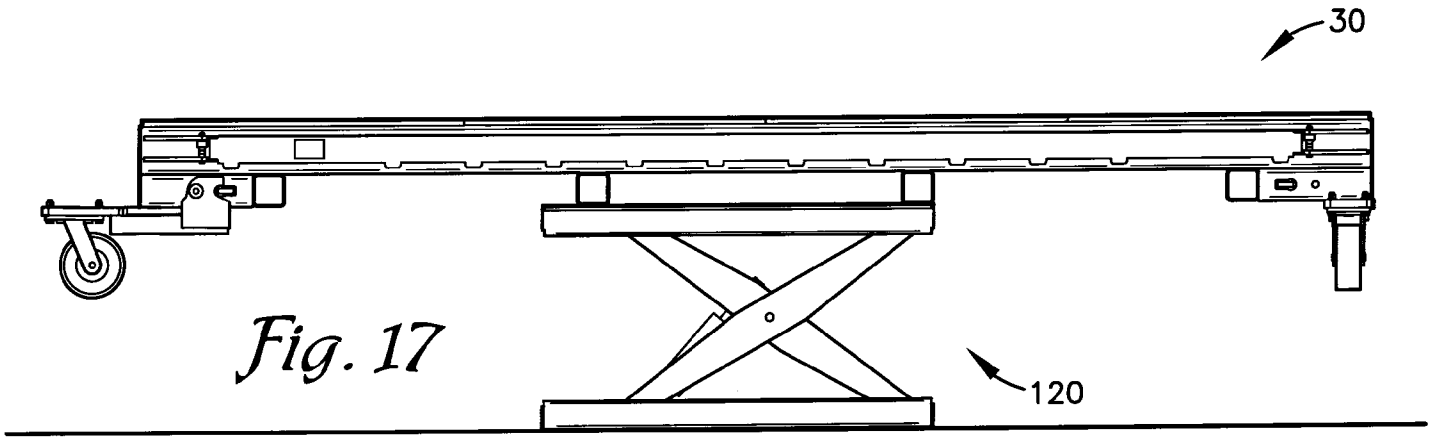
FIG. 17 is a side elevation view of the lift of FIG. 16, wherein the lift is shown in a raised configuration.
Figures 18, 19:
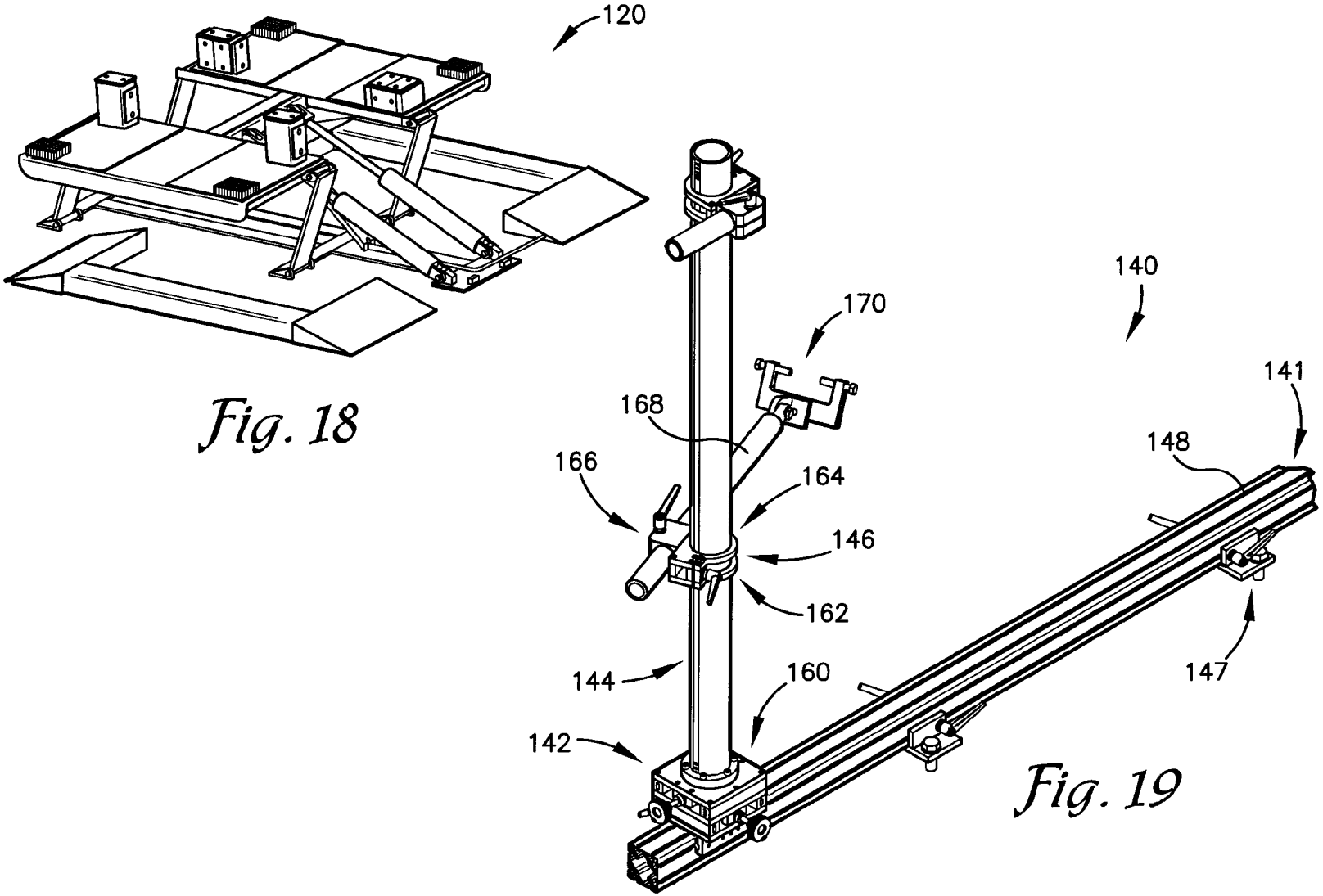
FIG. 18 is an isometric view of the lift of FIG. 17.
FIG. 19 is an isometric view of an embodiment of a repair jig for use with the trolley of FIG. 2.
Figure 21:
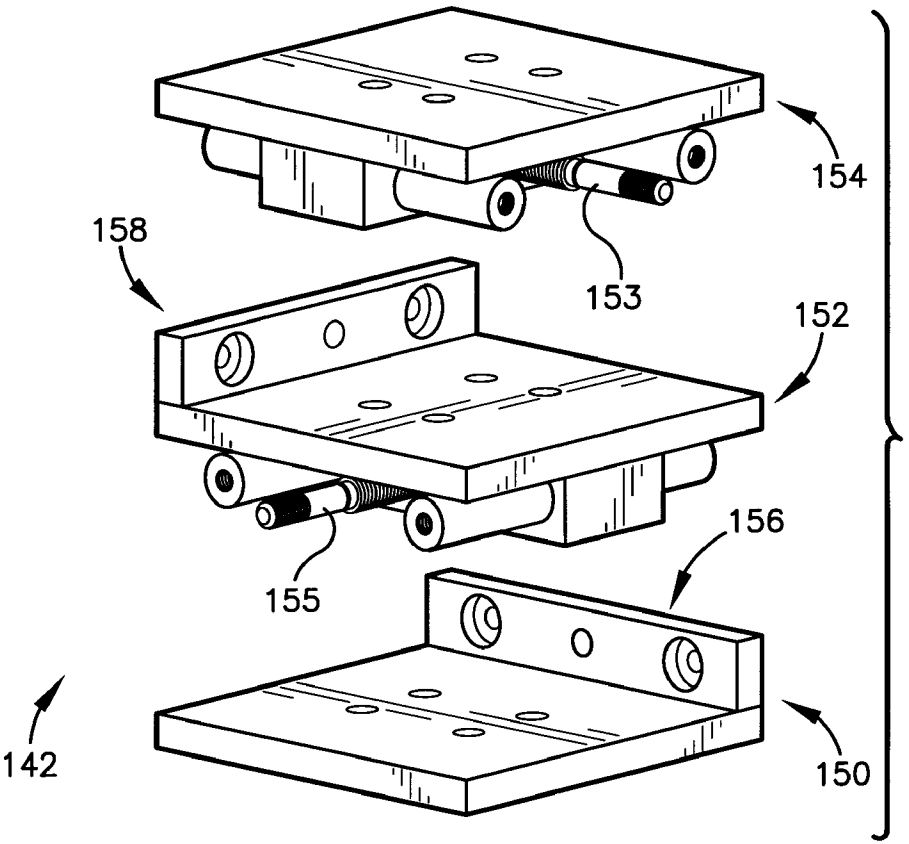
FIG. 21 is an exploded isometric view of the base of FIG. 20.
Figure 20:
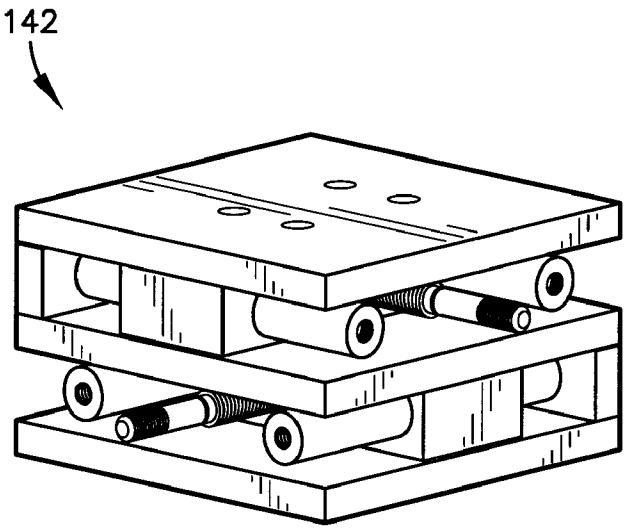
FIG. 20 is an isometric view of an embodiment of a base of the repair jig of FIG. 19.

Referring to FIGS. 16-18, an alternative embodiment of the lift 120 is shown which is located beneath the trolley 30, either by moving the trolley 30 over the lift 120 or moving the lift 120 under the trolley 30, to allow for raising and lowering the trolley 30 as desired, such as when a higher or lower working height is desired by the technician working on the vehicle supported on the trolley 30. The lift 120 may be a parallelogram-type lift, as shown in FIGS. 16-18, or a scissors-type lift as shown in FIGS. 13-15. Structural elements may be incorporated into the underside of the trolley 30 or upper side of the lift 120 to ensure that the lift 120 positively engages and centers the trolley 30 for safe lifting. When not being used for the trolley, the lift 120 can be used for other purposes, such as directly lifting a vehicle for maintenance and or repair including applying bending forces using pulling towers.

In yet another alternative embodiment, a lift is physically incorporated into the trolley.

In yet another embodiment, a lift 1300 is used to raise and lower the vehicle mounted on the bench 10, with the trolley 30 docked, in order to provide greater clearance for anchoring and unanchoring the vehicle. More specifically, the lift is located in or near the internal area 24 and operable to extend through the trolley 30 to act against the vehicle, thereby allowing for raising the vehicle to facilitate attaching or unattaching the anchoring hardware associated with the anchor member 36. In one embodiment, the lift 1300 is slidably positionable on the first and second trolley portions 38,40.

Referring also to FIGS. 19-23, a repair jig 140 is shown for use with the trolley 30 to facilitate the alignment and otherwise proper positioning of the portions of the vehicle being repaired. The repair jig 140 includes a rail 141, a base 142, an extension 144, and a fixture jig 146. The rail 141 includes securement elements 147 for securing the rail 141 to the trolley 30 or the bench 10, and an elongated channel 148. The base 142 both slidably couples with the rail 141 and allows for adjustments in at least two dimensions of the position of the fixture jig 146. More specifically, referring particularly to FIGS. 20 and 21, the base 142 includes lower, middle, and upper elements 150,152,154. The lower element 150 is substantially fixed relative to the middle and upper elements 152,154; the middle element 152 is movable in a first horizontal direction relative to the lower element 150; and the upper element 154 is movable in a second horizontal direction, which is perpendicular to the first horizontal direction, relative to the middle element 152. These movements may be accomplished by turning knobs attached to threaded members 153,155 running through the middle and upper elements 152,154 and acting against backing flanges 156,158 on the lower and middle elements 150,152, respectively. The lower element 150 is movable within the channel 148 to position the base 142 at substantially any point therealong, and, once positioned, is securable to the rail 141 to maintain that position.

The extension 144 may take the form of an elongated shaft, as shown, including first and second ends 160,162. The first end 160 is attached to the upper element 154 of the base 142.

Figures 22, 23:
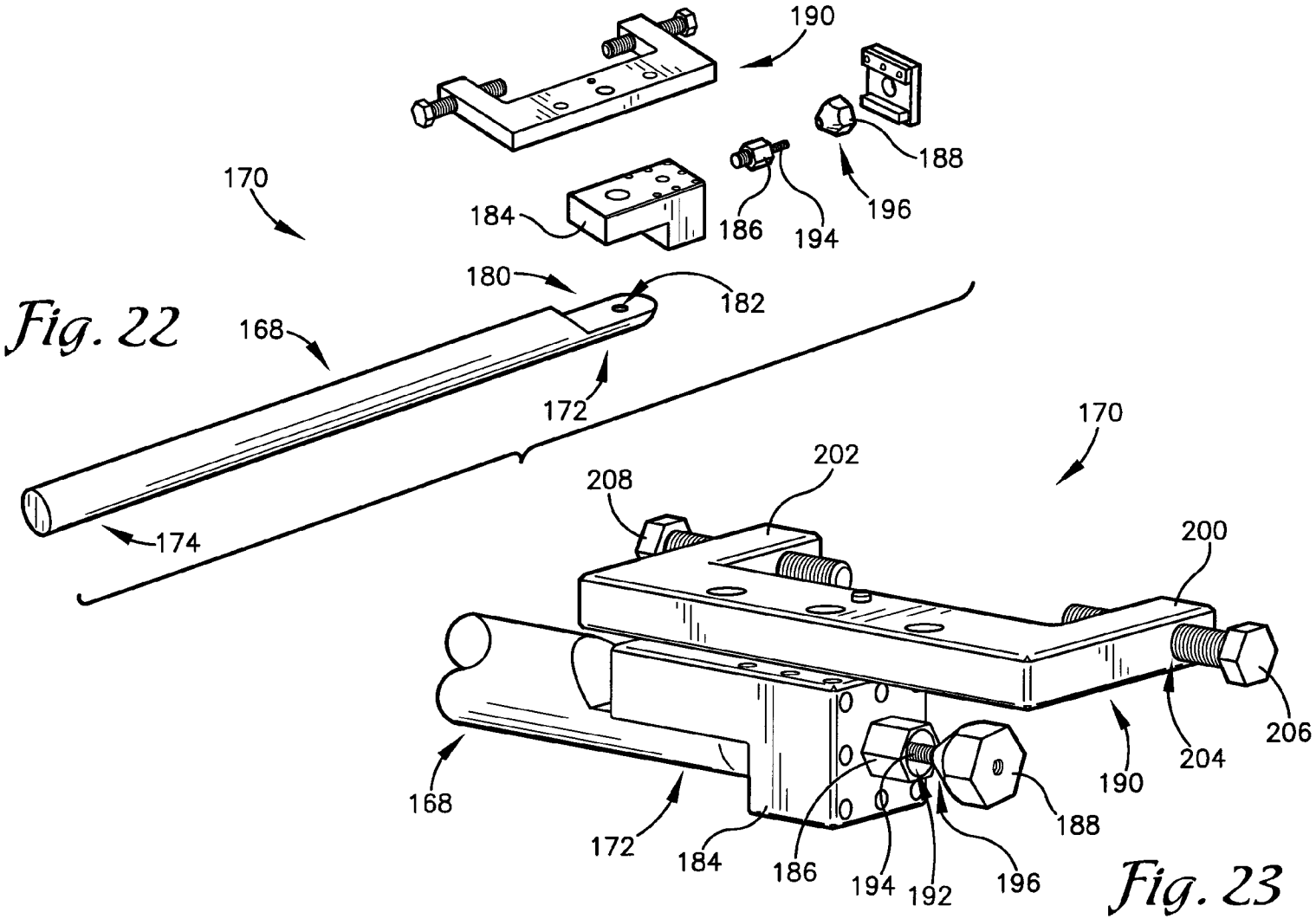
FIG. 22 is an exploded isometric view of an embodiment of an arm and fixture jig of the repair jig of FIG. 19.
FIG. 23 is a fragmentary isometric view of the arm and fixture jig of FIG. 22.
Figure 24:
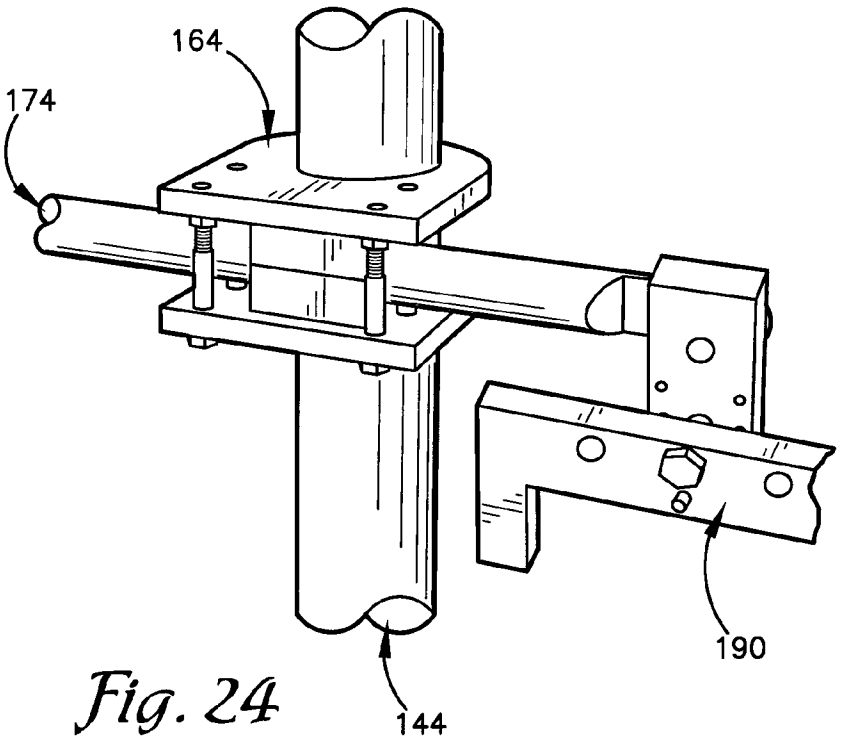
FIG. 24 is a fragmentary isometric view of the arm and fixture jig of FIG. 22.

Referring also to FIGS. 22-24, the fixture jig 146 includes first and second clamps 164,166, an arm 168, and a fixture clamp 170. The first clamp 164 selectively secures the fixture jig 146 on the extension 144. The first clamp 164 is both vertically positionable on the extension 144 and rotatably positionable about the extension 144. The second clamp 166 is orientable substantially perpendicular to the first clamp 164 and secures the arm 168. The second clamp 166 may be rotatable relative to the first clamp 164; additionally or alternatively, the second clamp 166 may be horizontally and/or vertically positonable relative to the first clamp 164.

The arm 168 is horizontally and rotatably positionable within the second clamp 166. The arm 168 may take the form of an elongated shaft, as shown, including first and second ends 172,174. The first end 172 includes a substantially flattened portion 180 and a hole 182. The fixture clamp 170 is coupled to the first end 172 of the arm 168 using a bolt or other fastener extending through the hole 182.

The fixture clamp 170 includes a pivot block 184, a screw receiver 186 and a screw head 188, and a clamp block 190. The pivot block 184 is coupled with the flat portion 180 of the arm 168 by the bolt or other fastener received within the hole 182. The pivot block 184 is pivotably positionable about the bolt or other fasteners.

The screw receiver 186 couples with an end of the pivot block and includes a concave portion 192. A threaded rod 194 extends outwardly from a center area of the concave portion 192. The screw head 188 presents a convex portion 196 which substantially corresponds to the concave portion 192 of the screw receiver 186. The screw head 188 screws onto the threaded rod 194. In use, the threaded rod 194 can be passed through an existing hole in the vehicle, and the screw head 188 can be screwed onto the threaded rod 194 so as to trap the material surrounding the hole in the vehicle between the screw receiver 186 and the screw head 188 and thereby further secure the fixture clamp 170 in position. The convex portion 196 automatically centers and effectively expands, as the screw head 188 is screwed onto the threaded rod 194, in the hole in the vehicle, thereby accommodating substantially any size hole. The concave portion 192 receives that part of the convex portion 196 that extends through the hole in the vehicle.

The clamp block 190 is secured to the top of the pivot block 184 using a bolt or other fastener. The clamp block 190 may include a first arm 200 spaced apart from and oriented parallel to a second arm 202. Each arm 200,202 includes an internally-threaded hole 204 for receiving an externally-threaded bolt or rod 206,208. The bolts or rods 206,208 secure a fixture in a desired position relative to the portion of the vehicle being repaired. The clamp block 190 may include a plurality of spaced-apart holes allowing for positioning the clamp block 190 relative to the pivot block 184 prior to securing it in place with a bolt or other fastener received within one of the holes (compare, e.g., FIGS. 23 and 24). Additionally, the pivot block 184 and the clamp block 190 may include cooperative structural elements, e.g., male protrusions and corresponding female recesses, to further engage the blocks 184,190 and prevent undesired movement of one relative to the other, including undesired rotation about the bolt or other fastener.

It will be appreciated that the pivot block 184 can also couple with substantially any appropriate attachments or fixtures other than the clamp block 190.

Thus, the repair jig 140 allows for a substantial degree of flexibility and freedom in positioning the clamp block 190 or other attachment or fixture. As discussed, the base 142 allows for horizontal adjustments; the first clamp 164 allows for rotational and vertical adjustments; the second clamp 166 allows for rotational and horizontal adjustments, and, in one embodiment, vertical adjustments; the pivot block 184 allows for rotational and (by repositioning the clamp block 190 or other attachment or fixture on the pivot block 184) horizontal and vertical adjustments.

Figure 25:
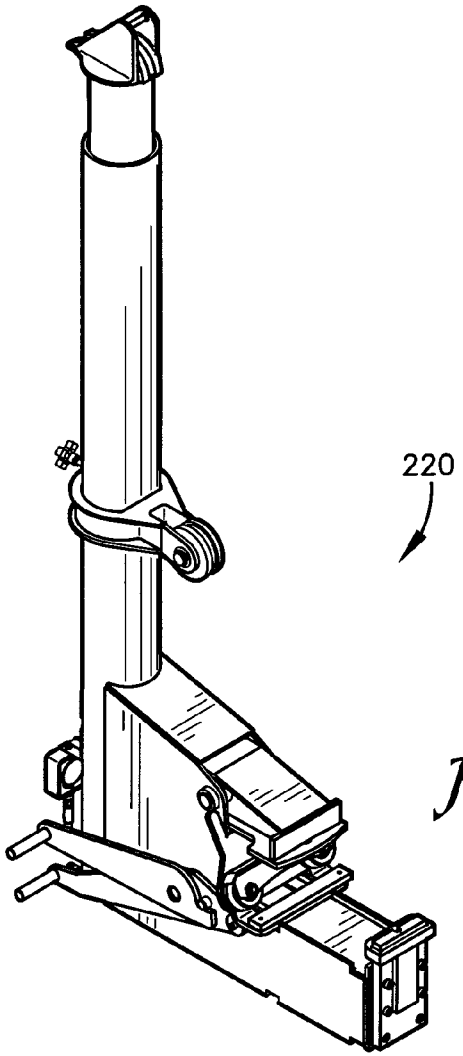
FIG. 25 is an isometric view of an embodiment of a pulling device for use with the bench of FIG. 1 or the trolley of FIG. 2.
Figure 26:
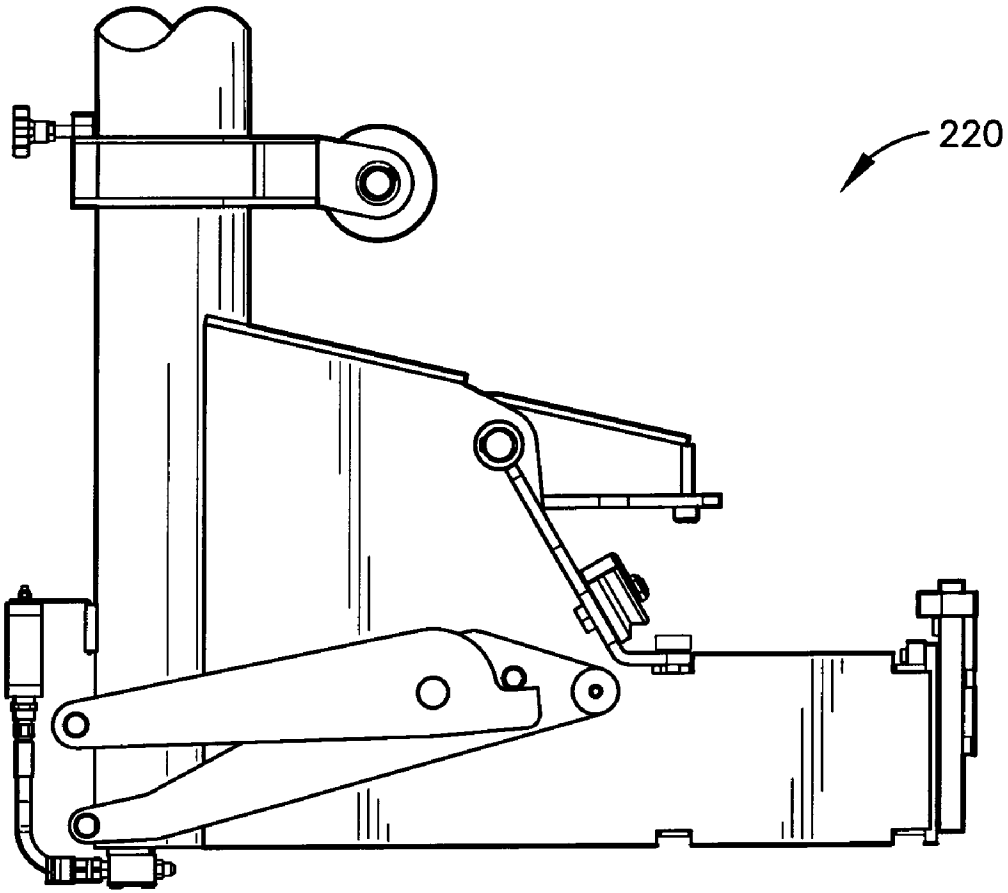
FIG. 26 is a side elevation view of an embodiment of a pulling device of FIG. 25.

Referring also to FIGS. 25 and 26, a pulling apparatus 220 is shown which may be coupled with the bench 10 for exerting a pulling force on a portion of the vehicle being repaired. Lesser repairs, requiring no more than approximately five tons of pulling force, can be accomplished on the trolley 30 without requiring that it be docked with the bench 10. Greater repairs, requiring up to approximately ten tons or more of pulling force, can be accomplished once the trolley 30 is docked with the bench 10.

Alternatively, as mentioned, a pulling apparatus similar to that which is disclosed in U.S. Pat. No. 6,925,848, titled "Multiple Movable Carriages with Multi-Radius Tracks and Tilted Rollers," may be used with the bench 10.

Referring also to FIG. 27, a removable crossmember 224 is positionable across the opening 22 in the bench 10 between the first and second portions 12,14 when it is desired to use the bench 10 without first docking the trolley 30 therewith. When the trolley 30 is docked, the trolley 30 fulfills the function of the crossmember 224. However, when the trolley 30 is not docked, the pulling force exerted on the vehicle can cause the first or second portion 12,14, or both, to bend inward into the internal area 24 where the trolley 30 would be. Thus, the removable crossmember 224 prevents such inadvertent and undesirable bending of the first and second portions 12,14 under these circumstances.

In one embodiment, a switch or other sensor is incorporated into the bench 10 to confirm the presence of either the crossmember 224 or the trolley 30. For example, a switch may be incorporated into the inner surface of the first or second bench portion 12,14 so that when the crossmember 224 or the trolley 30 is properly positioned within the internal area 24, such that the crossmember 224 or the trolley 30 abuts the first or second bench portion 12,14, the switch is activated and an indicator or a telltale is lit.

By way of example, and not limitation, the trolley 30 may be used to facilitate frame repair as follows. First, the bench 10 is lowered and ramps are attached to or extended from the bench 10 and/or the bench 10 is tilted, the vehicle is loaded thereon, and the ramps are removed or retracted and/or the bench 10 is leveled. Next, the trolley 30 is pushed through the opening 22 into the internal area 24 defined by the bench 10. Then, the bench 10 is raised so that the teeth 56 engage the slots 26 and the supports 34 of the trolley 30 are lifted clear of the floor. Next, the vehicle is raised to provide greater clearance for attaching the anchor member 36. Then, the anchor member 36 is bolted onto the trolley 30, and anchor hardware is used to secure the vehicle to the anchor member 36. Next, the repair jig 140 is coupled with the trolley 30 or bench 10, the vehicle is lowered, the anchor hardware is adjusted as necessary, and the fixture jig 170 is adjusted as desired. Thereafter, the desired repairs are accomplished.

It will be appreciated that certain of these steps depend upon, and may change as a result of changes in, the relative heights of the bench and trolley. For example, if the trolley is made lower or lowerable, then it is possible to first dock the trolley with the bench and then load the vehicle.

If it is desired to temporarily remove the vehicle from the bench 10, the bench 10 is lowered until the teeth 56 disengage from the slots 26 and the trolley's supports 34 are once again on the ground. The trolley 30, and the vehicle anchored thereto, can then be rolled or otherwise moved away from the bench 10.

Figure 28:
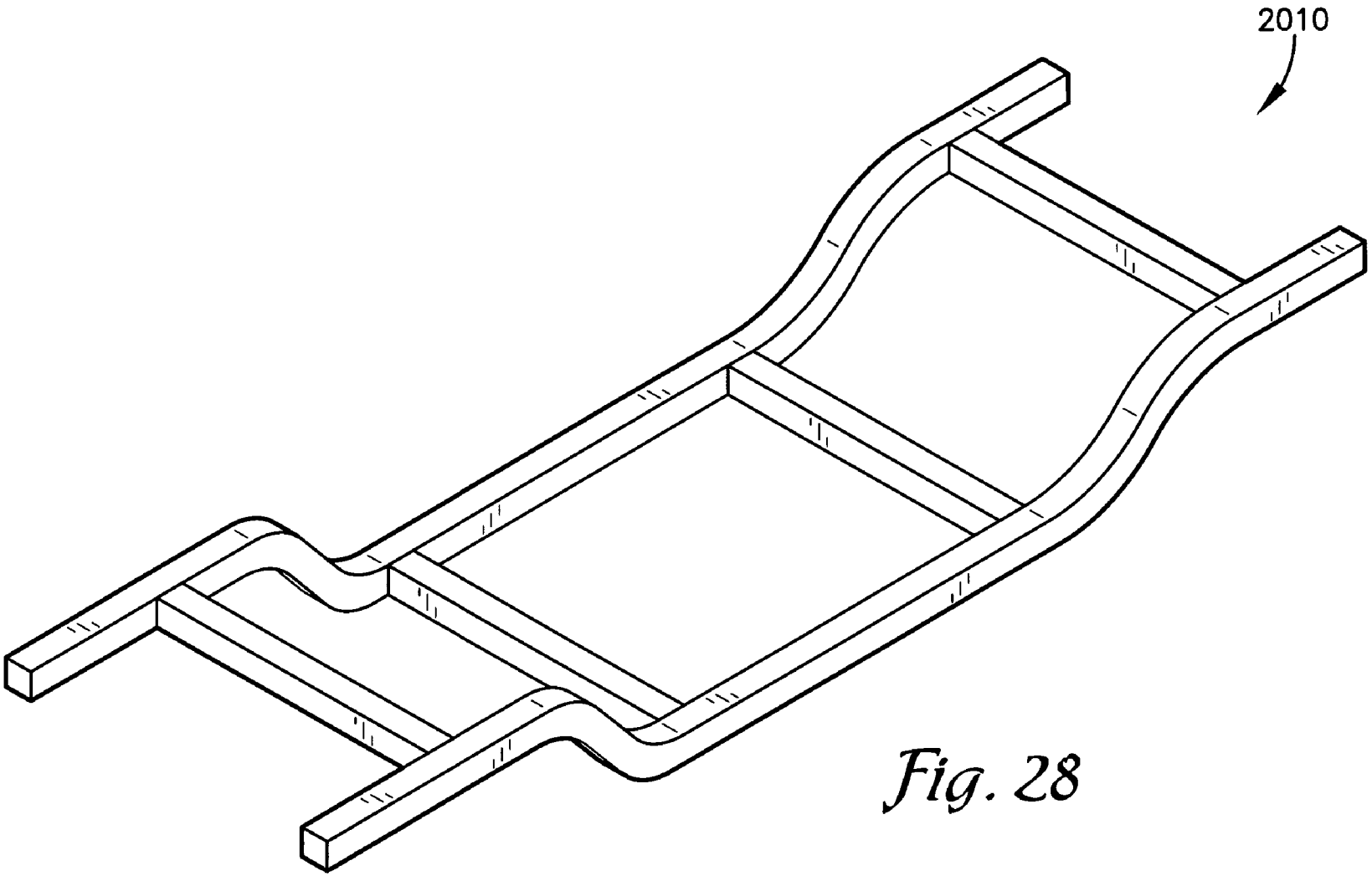
FIG. 28 is an isometric view of a frame of a vehicle.
Figure 29:
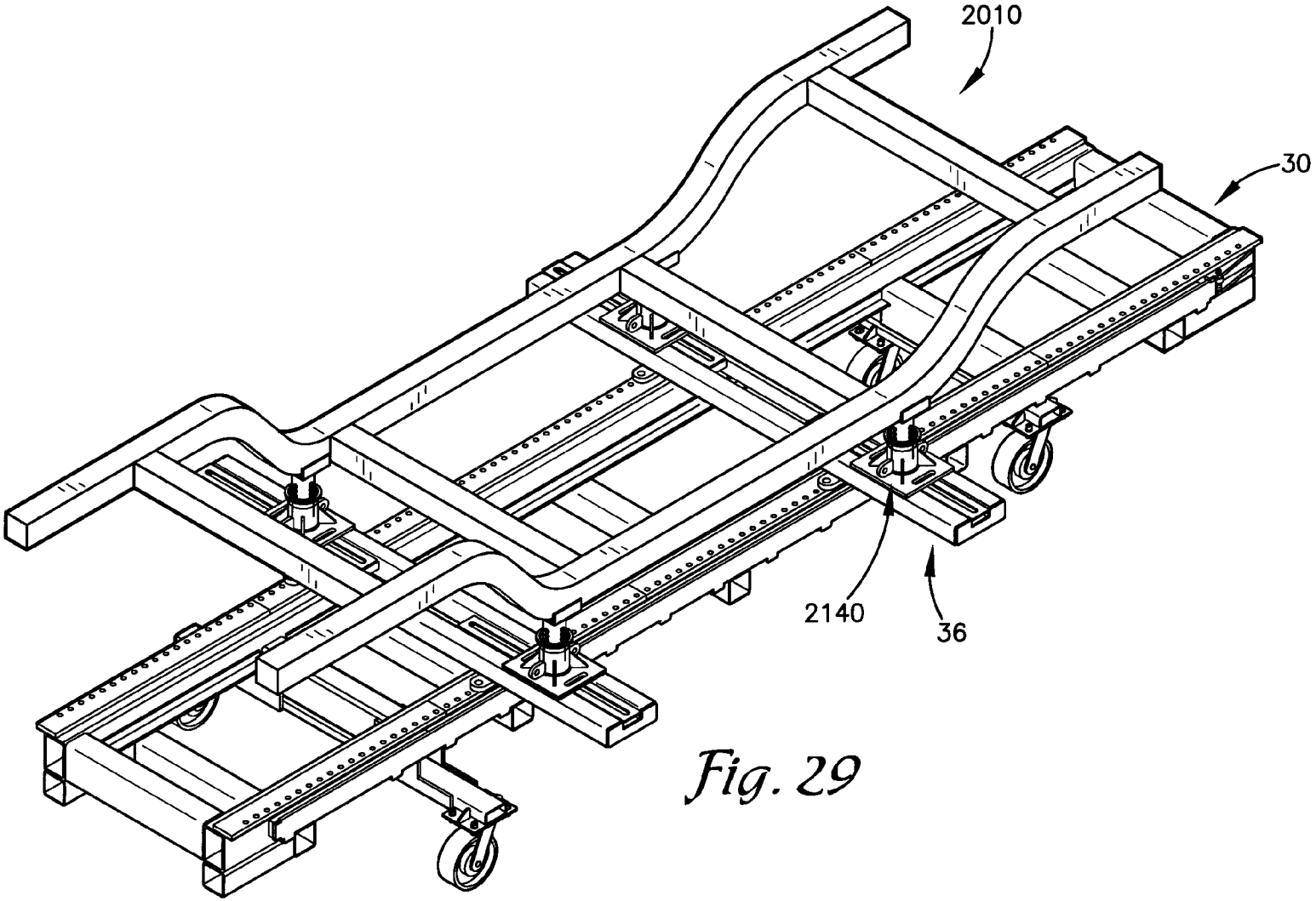
FIG. 29 is an isometric view of the frame of FIG. 28 mounted on the trolley of FIG. 2.
Figure 30:
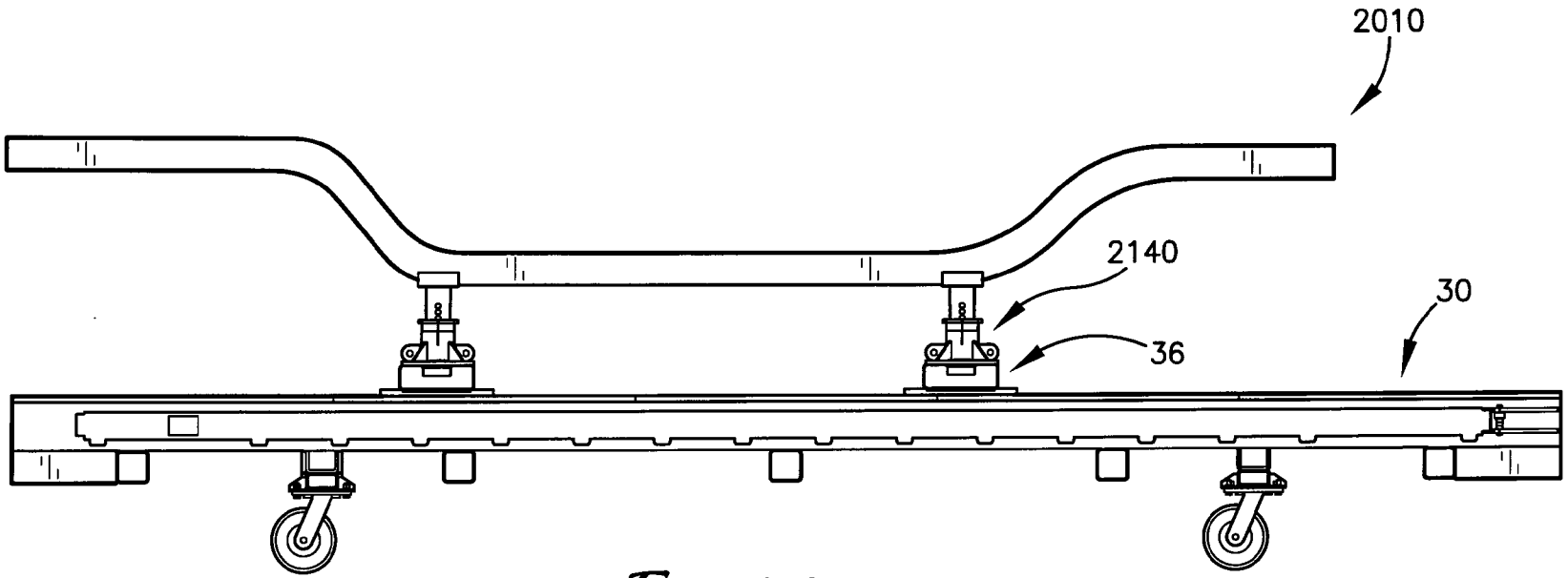
FIG. 30 is an elevation view of the frame and the trolley of FIG. 29.

Referring to FIGS. 28-34, in a full frame, or "body-on-frame," vehicle, the body of the vehicle is bolted to a structural frame that extends substantially the length of the vehicle. Referring particularly to FIG. 28, the frame 2010 includes two generally parallel, spaced-apart rails joined by crosspieces in a configuration similar to a ladder. If the frame is damaged, an alternative to repairing the frame is to replace it with an undamaged frame. The trolley 30 of the present invention can be used, along with a two-post lift 2072, shown in FIG. 33, to facilitate this replacement process. More specifically, referring particularly to FIGS. 29 and 30, a plurality of frame stands 2140 are coupled with one or more of the anchor members 36 to support the frame 2010 on the trolley 30.

Figures 31, 32:
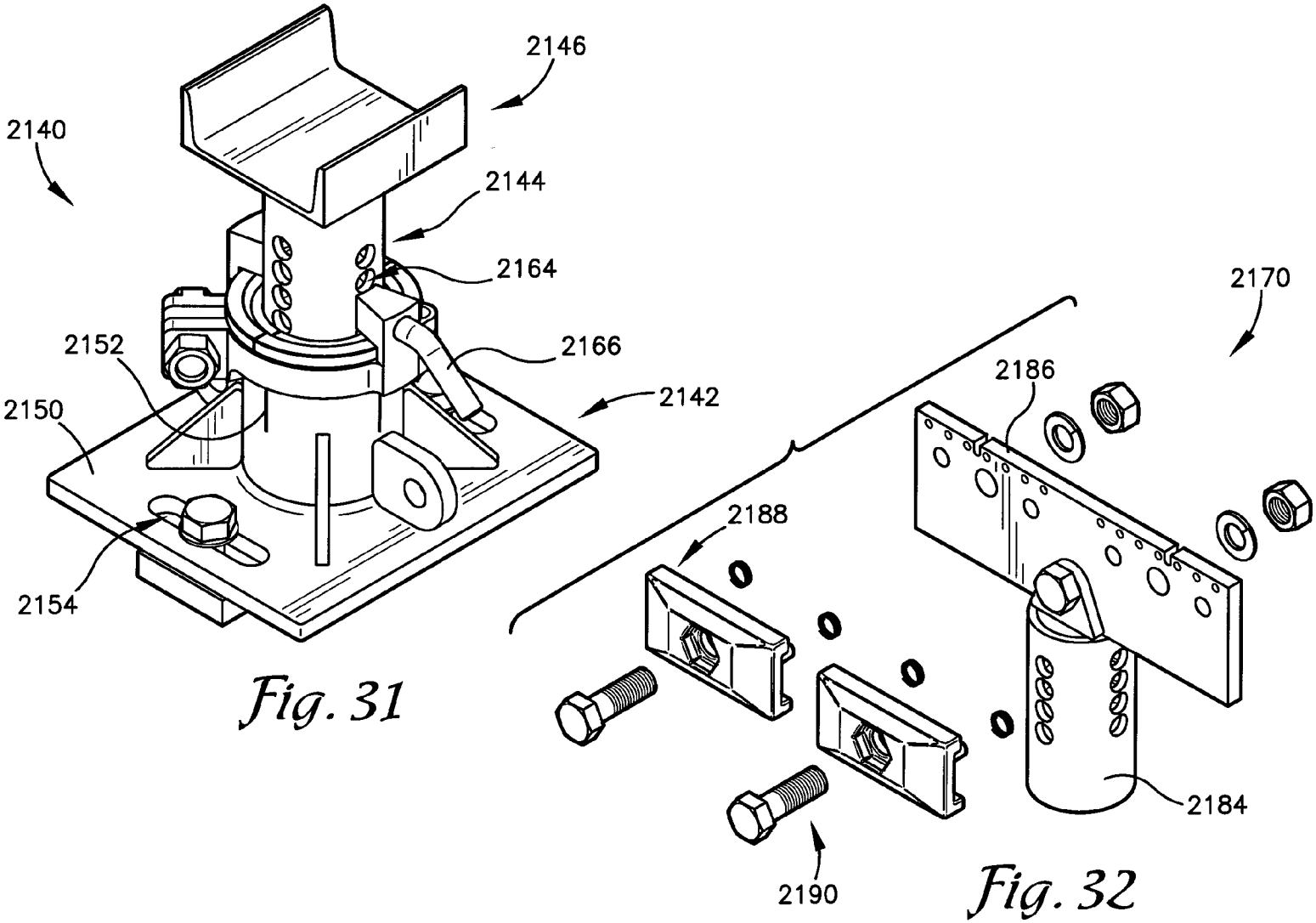
FIG. 31 is an isometric view of an embodiment of a frame stand component which is interposed between the frame and the trolley in FIGS. 29 and 30.
FIG. 32 is an exploded isometric view of an embodiment of a clamp fixture component for use in lifting a body of the vehicle off of the frame.

Referring particularly to FIG. 31, each frame stand 2140 includes a base 2142, an extension 2144, and a cradle 2146. The base 2142 both couples the frame stand 2140 with the anchor member 36 and allows for adjustments in at least two dimensions relative thereto. More specifically, the base 2142 includes a lower portion 2150 and a receiver 2152. The lower portion 2150 includes elongated slots 2154 for receiving bolts or other fasteners for coupling the base 2142 to the slots 68 in the anchor member 36. Thus, the base 2142 can be moved along the slots 68 in the anchor member 36 in a first direction which is perpendicular to the trolley 30, and the base 2142 can be moved along the slots 2154 in a second direction which is parallel to the_trolley 30. In one embodiment, the length of the elongated slots 2154 is approximately equal to the spacing between the series of holes 54 in the surface of the first and second trolley portions 38,40 so that the elongated slots 2154 in the base 2142 allow for making adjustments to the position of the cradle 2146 between adjacent holes 54. The receiver 2152 receives and secures the extension 2144.

The extension 2144 may take the form of an elongated shaft, as shown, including first and second ends and a series of holes 2164. The first end is slidably received within the receiver 2152 of the base 2142. The second end is coupled with the cradle 2146. The series of holes 2164 allow for varying the height of the cradle 2164 relative to the base 2142. More specifically, a pin 2166 is insertable into a selected one of the holes 2164 to accommodate the height of the cradle 2146 to the particular frame 2010 being supported.

The cradle 2146 securely receives a portion of the frame 2010. More specifically, a portion of the frame 2010, such as a portion of one of the rails, is securely received within the height-adjusted cradle 2146 so as to be securely supported by the frame stand 2140.

Figure 33:
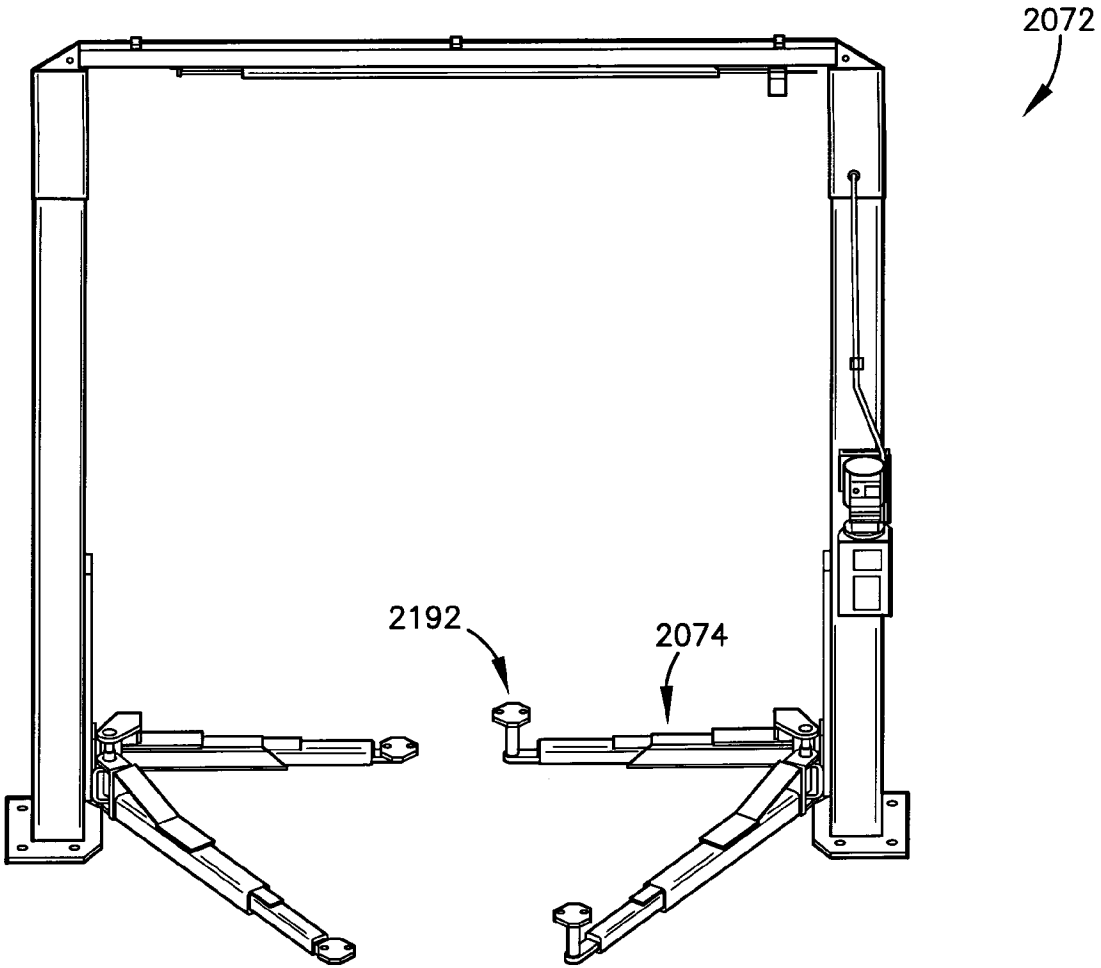
FIG. 33 is a perspective view of a two-post lift.

As mentioned, a two-post lift 2072, shown in FIG. 33, may be used to facilitate replacing the frame 2010 by allowing for separating the frame 2010 from the body. Referring to FIG. 32, a clamp fixture 2170 is shown for adapting the vehicle body to be secured by the two-post lift 2072. More specifically, the clamp fixture 2170 includes a securement member 2184, a faceplate 2186, and at least one clamping element 2188. The securement member 2184 is shaped so as to be securely received by the two-post lift 2072, as discussed below. In one embodiment, the securement member 2184 is substantially cylindrical, presents a series of holes, and is slidably receivable into the receiver 2152 of the base 2142 of the frame stand 2140 in substantially the same manner as the extension 2144 to allow the trolley 30 to support the body when desired. The faceplate 2186 is coupled to the securement member 2184. The clamping element 2188 cooperates with the faceplate 2186 to receive a portion of the vehicle body, such as a vertical weld flange, securely therebetween. In one embodiment, the clamping element 2188 is coupled with the faceplate 2186 using_threaded fasteners 2190 which can be adjusted to control the clamping force applied to the portion of the vehicle body.

Figure 35:
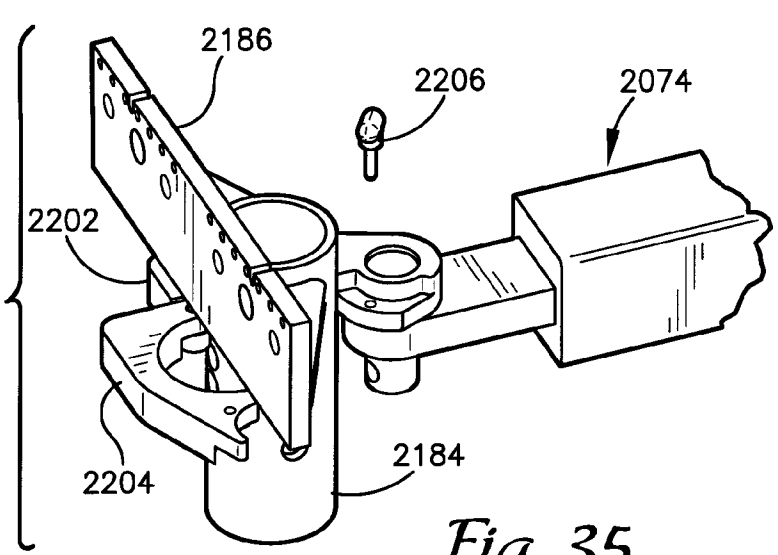
FIG. 35 is a fragmentary partially exploded isometric view of a first step in securing the hinged adaptor of FIG. 34 to the clamp fixture of FIG. 32.
Figure 34:
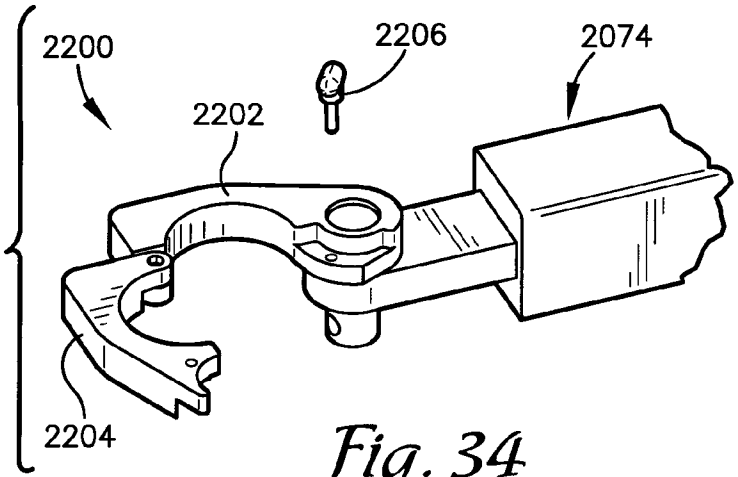
FIG. 34 is a fragmentary partially exploded isometric view of an embodiment of a hinged adaptor component for attachment to the two-post lift of FIG. 33 for use in cooperation with the clamp fixture of FIG. 32 in lifting the body of the vehicle off of the frame.
Figure 36:
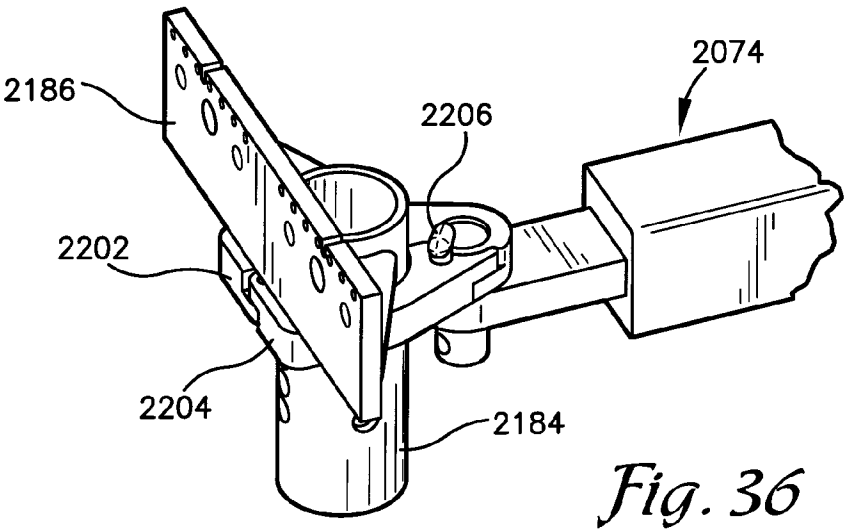
FIG. 36 is a fragmentary partially exploded isometric view of a second step in securing the hinged adaptor of FIG. 34 to the clamp fixture of FIG. 32.

Referring particularly to FIGS. 34-36, the conventional lift pads 2192 on the ends of the arms 2074 of the two-post lift 2072 are removed and replaced with hinged adapters 2200. Each hinged adaptor is operable to securely receive the securement member 2184 of the clamp fixture 2170. In one embodiment, each hinged adapter 2200 includes a first portion 2202 having first and second ends, with the first end being coupleable with the arm 2074, and a second portion 2204 having first and second ends, with the first end being hingedly coupled with the second end of the first portion 2202 and the second end being securable to the first end of the first portion, wherein when the first and second portions 2202,2204 are closed they define an internal area for closely receiving the securement member 2184 of the clamp fixture 2170. A removable pin 2206 may be used to secure the first and second portions 2202,2204 in the closed position, i.e., to secure the second end of the second portion 2204 to the first end of the first portion 2202. The process of receiving and securing the securement member 2184 with the hinged adaptor 2200 is clearly shown in FIGS. 34, 35, and 36.

By way of example, and not limitation, the trolley 30 may be used to facilitate frame replacement as follows. The vehicle is raised, such as by the two-post lift 2072, and the trolley 30 is positioned thereunder. The frame stands 2140 are positioned and appropriately adjusted. The vehicle is lowered such that appropriate portions of the frame 2010 are received within the cradles 2146 of the frame stands 2140. The clamp fixtures 2170 are clamped to the vehicle's body at appropriate locations, such as at the vertical weld flanges. The hinged adaptors 2200, having been installed on the two-post lift 2072, are secured to the clamp fixtures 2170. The frame 2010 and body are disconnected, such that the body merely rests on the frame 2010. The two-post lift 2072 is actuated to raise the body from the frame 2010. The trolley 30 and the damaged frame 2010 it supports are then rolled away. A replacement frame 2010, supported on the same or a different instance of the trolley 30, is then rolled into position beneath the body. The body is then lowered onto the replacement frame 2010 and the aforementioned process is reversed.

It will also be appreciated that, once the frame and body are separated, repairs can be made to the frame or body while mounted on the trolley, as desired.

Although the invention has been disclosed with reference to various particular embodiments, it is understood that equivalents may be employed and substitutions made herein without departing from the scope of the invention as recited in the claims. For example, though shown as a movable trolley dockable with and separable from a stationary bench, the invention also encompasses the reverse embodiment of a movable bench dockable with and separable from a stationary trolley.

Having thus described the preferred embodiment of the inventions, What is claimed as new and desired to be protected by Letters Patent includes the Following:

1. A system comprising:

a frame-straightening bench including bench portions defining an internal area and a laterally accessible opening into the internal area;

a trolley including a body adapted to fit through the opening in the bench and into the internal area, and an anchor member coupled with the body and adapted to allow for anchoring a vehicle to the trolley, wherein the frame-straightening bench and the trolley are dockable with and separable from one another; and a sensor mounted on the bench and operable to determine whether the trolley is fully received into the internal area.

2. The system as set forth in claim 1, wherein the frame-straightening bench is coupled with and supported by a plurality of rollable supports to facilitate docking the frame-straightening bench with and separating the frame-straightening bench from the trolley.

3. The system as set forth in claim 1, wherein the trolley is coupled with and supported by a plurality of rollable supports to facilitate docking the trolley with and separating the trolley from the frame-straightening bench.

4. The system as set forth in claim 3, wherein each of the rollable supports is removably coupleable with the trolley in at least two different orientations relative to the body of the trolley.

5. The system as set forth in claim 1, wherein at least one of the bench portions includes a series of spaced-apart slots located along an edge adjacent to the internal area, and wherein the trolley includes a corresponding series of spaced-apart teeth which fit within the series of spaced apart slots.

6. The system as set forth in claim 5, wherein the spaced-apart slots and spaced-apart teeth are not evenly spaced-apart, such that the spaced-apart teeth will only fit within the spaced-apart slots when the bench and trolley are in particular relative positions.

7. The system as set forth in claim 1, wherein the trolley further includes a plurality of guide rollers located on the body for facilitating inserting the trolley through the opening and into the internal area.

8. The system as set forth in claim 1, wherein the body of the trolley is chamfered to facilitate insertion of the trolley through the opening and into the internal area.

9. The system as set forth in claim 1, wherein the opening of the bench is chamfered to facilitate insertion of the trolley through the opening and into the internal area.

10. The system as set forth in claim 1, wherein the anchor member further includes an anchor base having a first elongated slot oriented in a first direction and a second elongated slot oriented in a second direction, wherein the second direction is substantially perpendicular to the first direction, and operable to allow for adjusting in two dimensions the position of the anchor hardware.

11. The system as set forth in claim 1, further including a lift incorporated into the bench and adapted to raise and lower both the bench and the trolley docked therewith.

12. The system as set forth in claim 11, wherein the lift includes a vertically elongated slot at one end to allow for tilting the bench and the trolley docked therewith.

13. The system as set forth in claim 11, wherein the lift includes a locking feature for preventing inadvertent lowering of the lift.

14. The system as set forth in claim 1, further including a repair jig coupled with the trolley and operable to securely position a portion of the vehicle being repaired.

15. The system as set forth in claim 1, further including a pulling apparatus coupled with the bench or with the trolley for exerting a pulling force on a portion of the vehicle being repaired.

16. The system as set forth in claim 1, further including a removable crossmember selectively positionable across the opening in the bench when it is desired to use the bench without first docking the trolley therewith.

17. A system comprising:

a frame-straightening bench including bench portions defining an internal area and a laterally accessible opening into the internal area, wherein the bench further includes a plurality of guide rollers located at the opening for facilitating inserting the trolley through the opening and into the internal area;

a trolley including a body adapted to fit through the opening in the bench and into the internal area, and an anchor member coupled with the body and adapted to allow for anchoring a vehicle to the trolley, wherein the frame-straightening bench and the trolley are dockable with and separable from one another.

18. A system comprising:

a frame-straightening bench including bench portions defining an internal area and a laterally accessible opening into the internal area;

a trolley including a body adapted to fit through the opening in the bench and into the internal area, and an anchor member coupled with the body and adapted to allow for anchoring a vehicle to the trolley, wherein the frame-straightening bench and the trolley are dockable with and separable from one another; and a lift incorporated into the bench and adapted to raise and lower both the bench and the trolley docked therewith, wherein the lift includes a locking feature for preventing inadvertent lowering of the lift, wherein the locking feature includes a series of teeth, each of which substantially automatically engages at a different height as the lift is raised, and a disengagement mechanism for disengaging the series of teeth and allow the lift to be lowered.

19. A system comprising:

a frame-straightening bench including bench portions defining an internal area and a laterally accessible opening into the internal area;

a trolley including a body adapted to fit through the opening in the bench and into the internal area, and an anchor member coupled with the body and adapted to allow for anchoring a vehicle to the trolley, wherein the frame-straightening bench and the trolley are dockable with and separable from one another; and a repair jig coupled with the trolley and operable to securely position a portion of the vehicle being repaired, wherein the repair jig includes a rail including an elongated channel;

a base adapted both to slidably couple with the elongated channel of the rail and to allow for adjusting in at least two dimensions the positioning of the repair jig;

an extension in the form of an elongated shaft including a first end attached to the base; and a fixture jig including a fixture clamp, wherein the fixture jig is adapted to allow for adjusting in three dimensions the positioning of the fixture clamp, and the fixture clamp is operable to clamp on to the portion of the vehicle being repaired.

20. The system as set forth in claim 19, wherein the base includes lower, middle, and upper elements, with the middle element being movable in a first horizontal direction relative to the lower element, and the upper element being movable in a second horizontal direction, wherein the first horizontal direction is perpendicular to the second horizontal direction, relative to the middle element.

21. The system as set forth in claim 19, wherein the fixture jig further includes a screw receiver including a concave portion;

a threaded rod extending outwardly from a center area of the concave portion; and a screw head including a convex portion, wherein the threaded rod is passed through an existing hole in a vehicle, and the screw head is screwed onto the threaded rod so as to trap the material surrounding the hole in the vehicle between the screw receiver and the screw head, and wherein the convex portion effectively expands and centers itself, as the screw head is screwed onto the threaded rod, in the hole in the vehicle, thereby accommodating substantially any size hole, and wherein the concave portion accepts that part of the convex portion that extends through the hole in the vehicle.

* * * * *